US008366420B1

(12) United States Patent
Geschwender

(10) Patent No.: US 8,366,420 B1
(45) Date of Patent: Feb. 5, 2013

(54) LINEAR PERISTALTIC PUMP HAVING OPPOSING STAGGERED CURVED SURFACES

(76) Inventor: Robert C. Geschwender, Lincoln, NE (US)

( * ) Notice: Subject to any disclaimer, the term of this patent is extended or adjusted under 35 U.S.C. 154(b) by 440 days.

(21) Appl. No.: 12/694,803

(22) Filed: Jan. 27, 2010

(51) Int. Cl.
*F04B 43/08* (2006.01)
*F04B 43/12* (2006.01)

(52) U.S. Cl. ..... 417/475; 417/477.9

(58) Field of Classification Search ..... 417/474, 417/475, 476, 477.1, 477.2, 477.3, 477.4, 417/477.5, 477.6, 477.7, 477.8, 477.9, 477.11, 417/477.12, 477.13, 477.14
See application file for complete search history.

(56) References Cited

U.S. PATENT DOCUMENTS

| | | | | |
|---|---|---|---|---|
| 1,922,196 | A * | 8/1933 | Butler | 417/475 |
| 3,083,647 | A * | 4/1963 | Muller | 417/474 |
| 3,137,241 | A * | 6/1964 | Isreeli | 417/475 |
| 3,433,171 | A | 3/1969 | Corneil | |
| 4,561,830 | A * | 12/1985 | Bradley | 417/474 |
| 4,671,792 | A * | 6/1987 | Borsanyi | 604/153 |
| 4,746,279 | A * | 5/1988 | Manella | 417/474 |
| 4,909,710 | A * | 3/1990 | Kaplan et al. | 417/53 |
| 5,660,529 | A * | 8/1997 | Hill | 417/53 |
| 6,213,739 | B1 | 4/2001 | Phallen et al. | |
| 7,854,600 | B2 * | 12/2010 | Ogawa | 417/474 |

FOREIGN PATENT DOCUMENTS

| | | | |
|---|---|---|---|
| DE | 3202251 | A1 * | 8/1983 |
| EP | 426273 | A1 * | 5/1991 |

* cited by examiner

*Primary Examiner* — Devon Kramer
*Assistant Examiner* — Nathan Zollinger
(74) *Attorney, Agent, or Firm* — Suiter Swantz pc llo

(57) ABSTRACT

A pump producing peristaltic pumping action by sequentially occluding a tube between staggered curved surfaces. The pump includes a pump frame with a platen. The platen has an irregular surface forming a plurality of curved end surfaces. The irregular surfaces of the platen operatively interact with a pressure plate assembly having a plurality of pressure plates. The pressure plates are configured for translational motion. In operation the pressure plates are spaced one from another such that each one includes an end curved surface extending generally toward complementary staggered curved surfaces on the platen. Pumping is accomplished via a tube sandwiched between the platen and the pressure plate assembly. A drive operatively associated with the pump frame and pressure plate assembly drives the pressure plates in a wave sequence so as to sequentially occlude portions of the tube between staggered curved surfaces so as to promote a peristaltic pumping action within the tube.

3 Claims, 28 Drawing Sheets

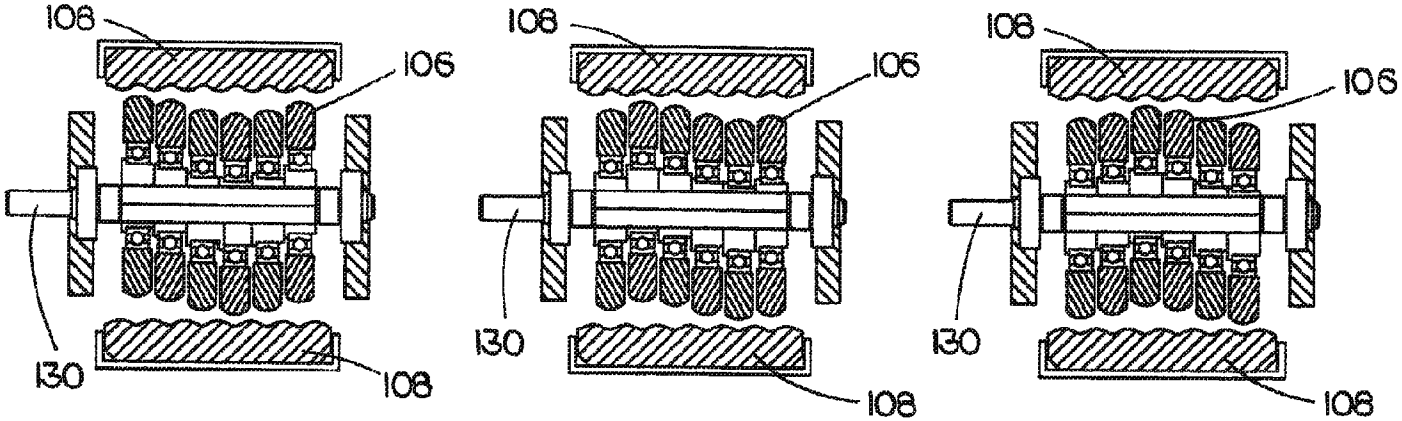
FIG. 10A
FIG. 10B
FIG. 10C
FIG. 10D
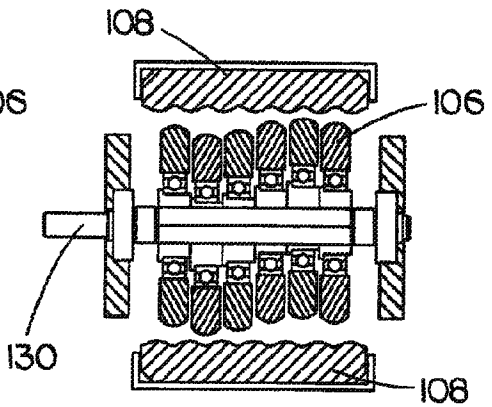
FIG. 10E
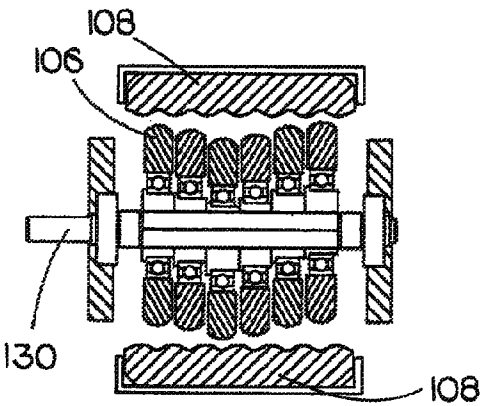
FIG. 10F

LINEAR PERISTALTIC PUMP HAVING OPPOSING STAGGERED CURVED SURFACES

TECHNICAL FIELD

The present invention is generally related to positive displacement pumps utilizing a peristaltic pumping action and more particularly to linear peristaltic pumps.

BACKGROUND OF THE INVENTION

In fluid pumping applications where cross contamination between a pump and the fluid to be pumped must be avoided, peristaltic pumps are preferred. There are generally two types of peristaltic pumps, namely rotary, and linear. Rotary peristaltic pumps utilize a rotor with a number of protuberances around the rotor's circumference or shaft. As the rotor rotates the protuberances (e.g., rollers, shoes, wipers, and the like) sequentially occlude the flexible tube. The part of the tube under compression closes (or "occludes") thus forcing the fluid through the tube. As the tube opens to its natural state (after each compression) fluid is restored inducing pumping action. This process has several analogs in biology and is called peristalsis, e.g., the gastrointestinal tract. Also known in the art of peristaltic pumps are linear peristaltic pumps.

SUMMARY OF THE INVENTION

The present invention is an improved linear peristaltic pump. This pump sequentially occludes a malleable resilient tube or hose between staggered opposed curved surfaces so as to peristaltically force flow-able materials through the tube or hose. The embodiment of the peristaltic pump incorporates a pump frame with a platen or platens and movable pressure plates. The platen or platens have a series of parallel raised curved surfaces which are perpendicular to the flow through the pump. The pressure plates with curved surfaces are parallel to the curved surfaces of the platen or platens and are positioned in a staggered opposed relationship to the curved surfaces of the platen or platens and they operatively interact in a sequential wave pattern against the platen or platens. This sequence of motion manipulates the tube or hose over the alternating staggered opposed curved surfaces as the pressure plates are actively moved in a wave pattern by the drive assembly operatively associated with the pump frame, to occlude the tube or hose, thus moving the flow-able material through the tube or hose. In another embodiment, in lieu of a platen, a second set of pressure plates is incorporated with the first set of pressure plates, each set being in staggered opposed relationship with the other and in reverse phase with each other, so as to occlude the transfer tube or hose between staggered curved surfaces in a wave pattern to promote flow through the tube or hose.

A first object of the present invention is to provide an improved peristaltic pump.

A second object of the present invention is to provide an improved linear peristaltic pump.

A third object of the present invention is to provide a linear peristaltic pump that produces a quasi-continuous flow.

A fourth object of the present invention is to provide a linear peristaltic pump which reduces backflow.

A fifth object of the present invention is to provide a peristaltic pump capable of drawing a vacuum in excess of 27 inches of mercury (approximately 70 Torr) at ambient standard temperature and pressure and producing pumping pressures of less than or equal to the failure limit of a flexible resilient hose or tube.

A sixth object of the present invention is to provide a method of pumping a fluid peristaltically between staggered curved surfaces.

A seventh object of the present invention is to provide an adjustable peristaltic pump.

An eighth object of the present invention is to provide a peristaltic pump capable of accurately mixing different pumpable materials at a desired ratio.

A ninth object of the present invention is to provide a peristaltic pump that may be adjusted to pump at different rates.

A tenth object of the present invention is to provide a peristaltic pump which without adjustment can accommodate tubes of varying diameters and like wall thicknesses.

An eleventh object of the present invention is to provide a peristaltic pump that may be easily adjusted to produce varying pressures.

A twelfth object of the present invention is to provide a peristaltic pump that may accommodate a number of stations, nozzles, and/or outputs.

These and other objects of the present invention will be apparent upon a review of this specification and its appended drawings.

BRIEF DESCRIPTION OF THE DRAWINGS

FIGS. 10A through 10F are top cross-sectional partial views of a mono-lateral peristaltic pump pressure plate drive assembly illustrating the serpentine pumping action and phase difference between opposing sides of the pressure plates and their respective platens at 60° drive shaft rotation intervals;

FIGS. 21 et al, 22, et al, and 23 et al, are schematic diagrams:

Figure 24:
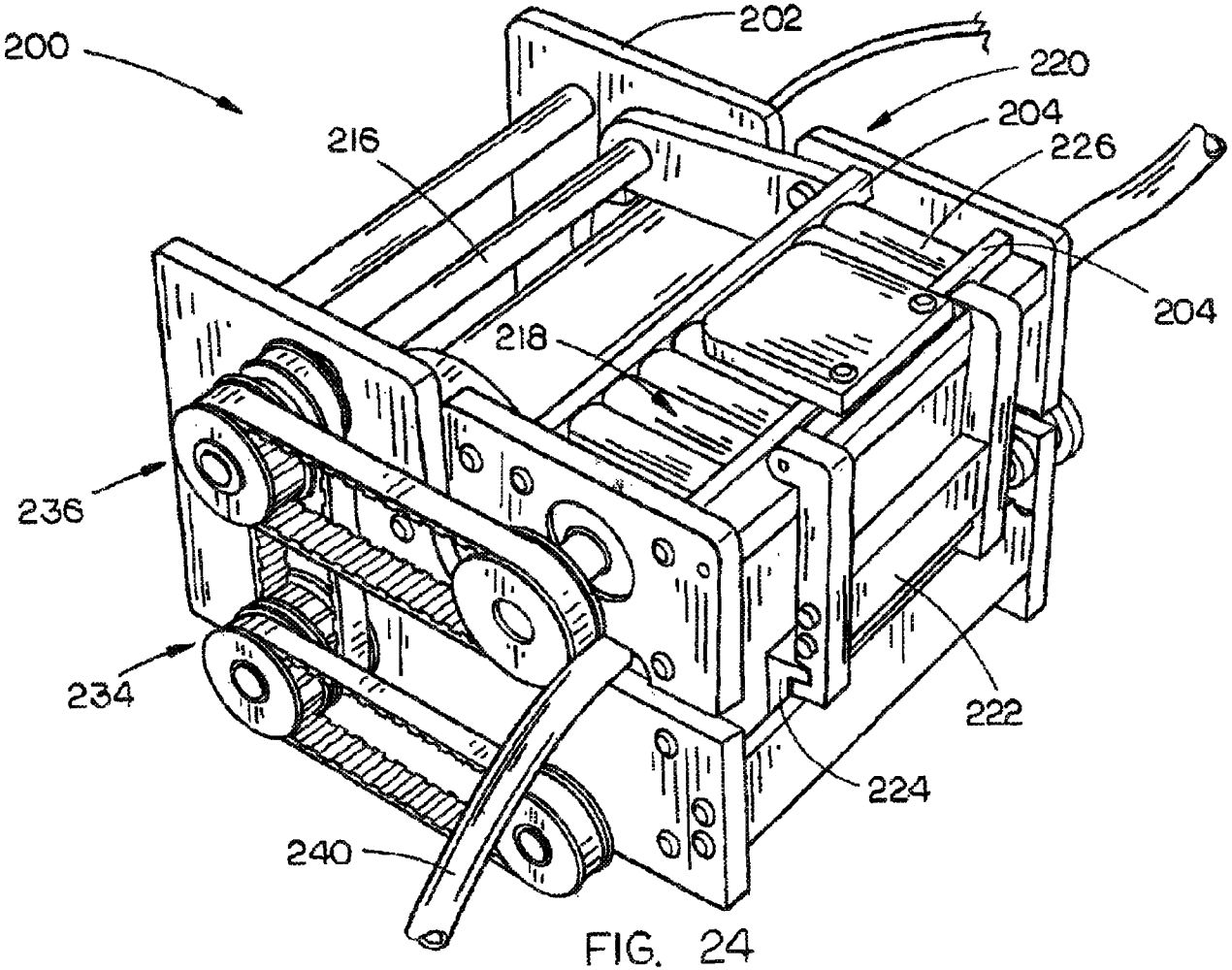
Figure 25:
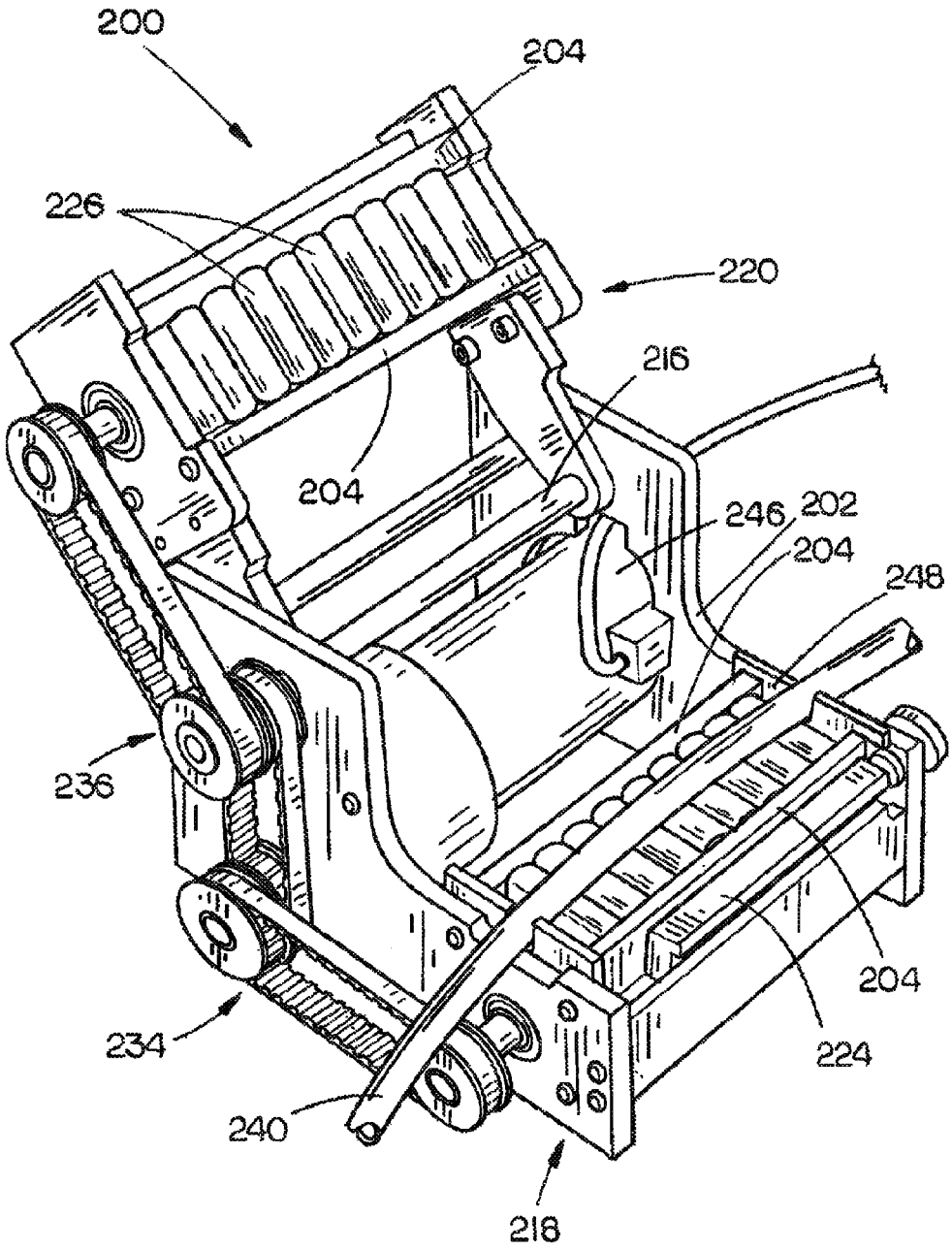
Figure 26:
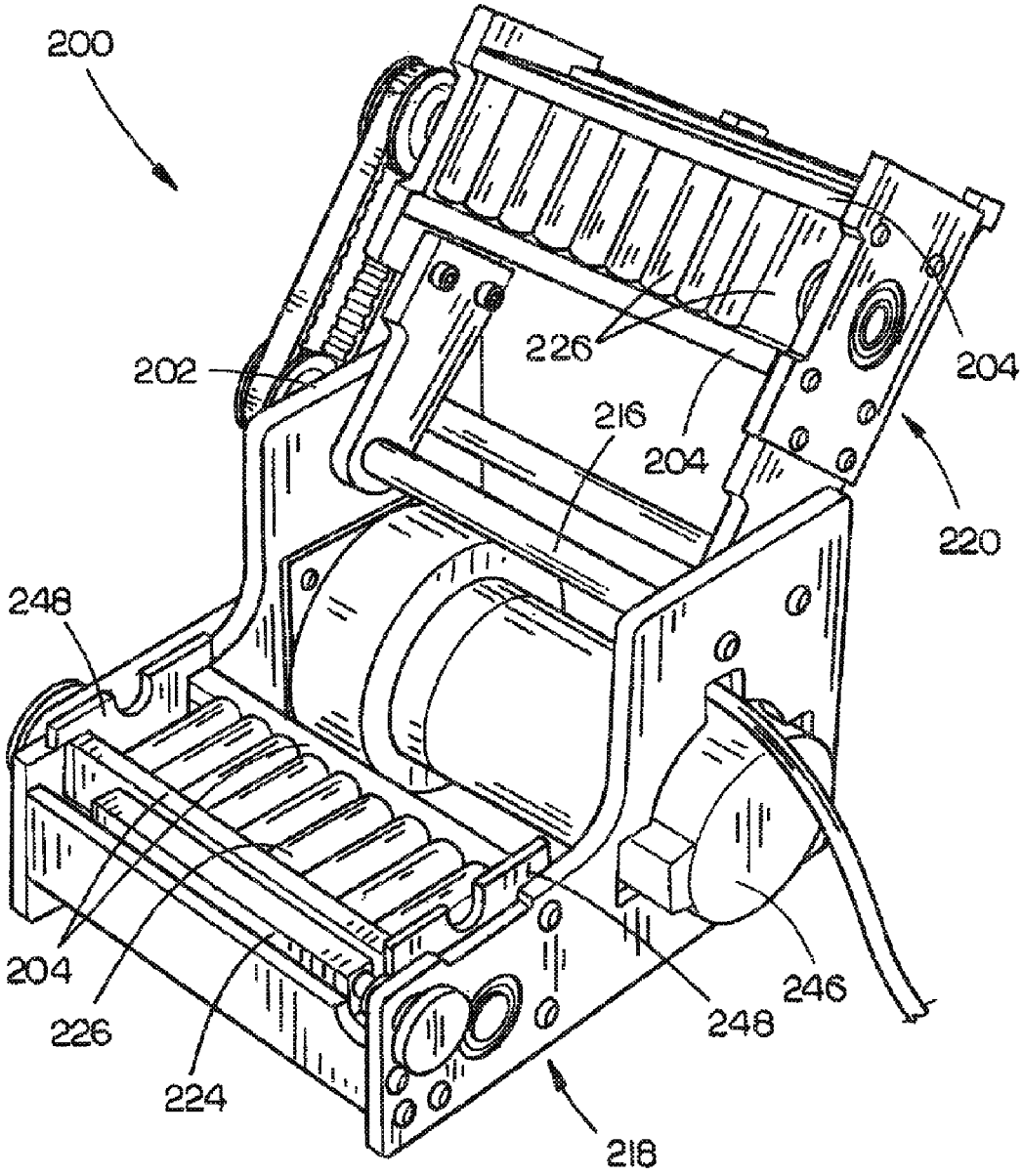
Figure 27:
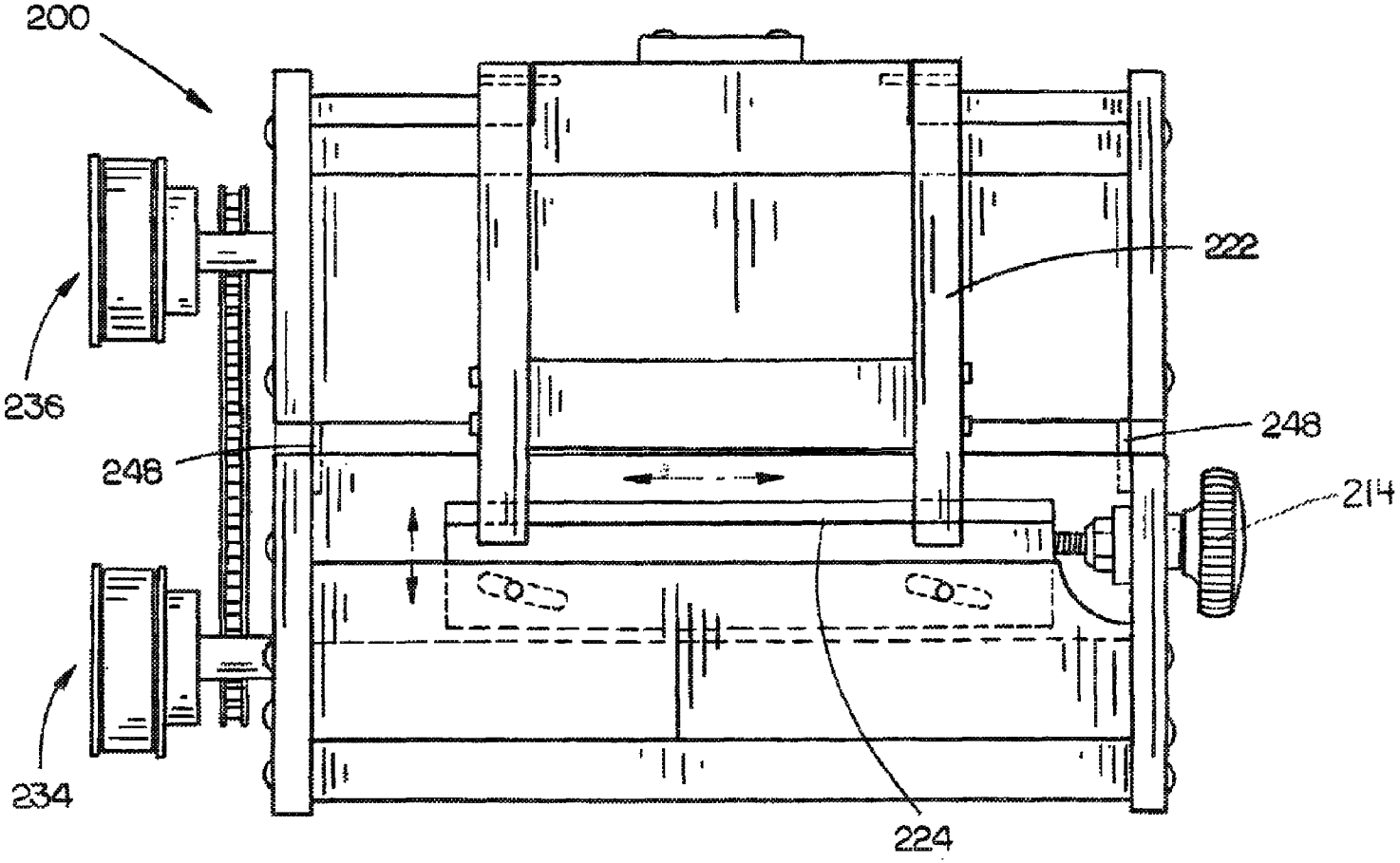
Figure 28A:
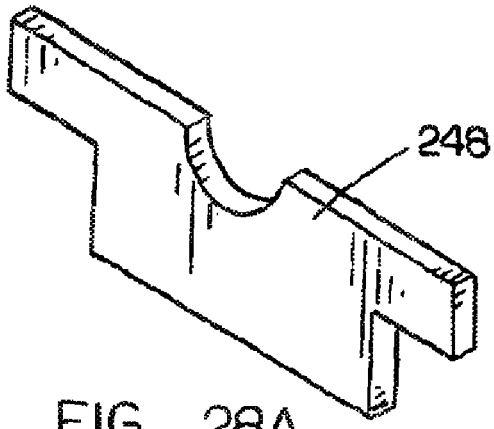
Figure 28B:
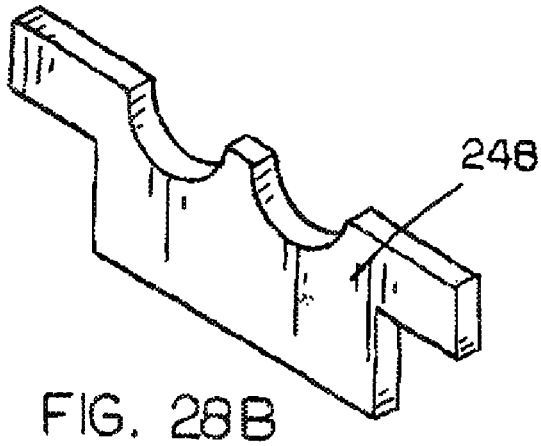
Figure 28C:
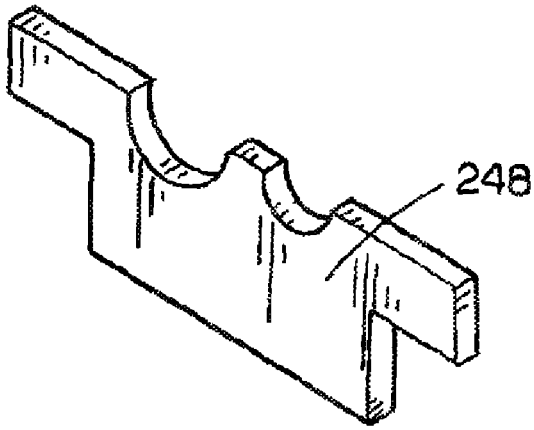
Figure 29:
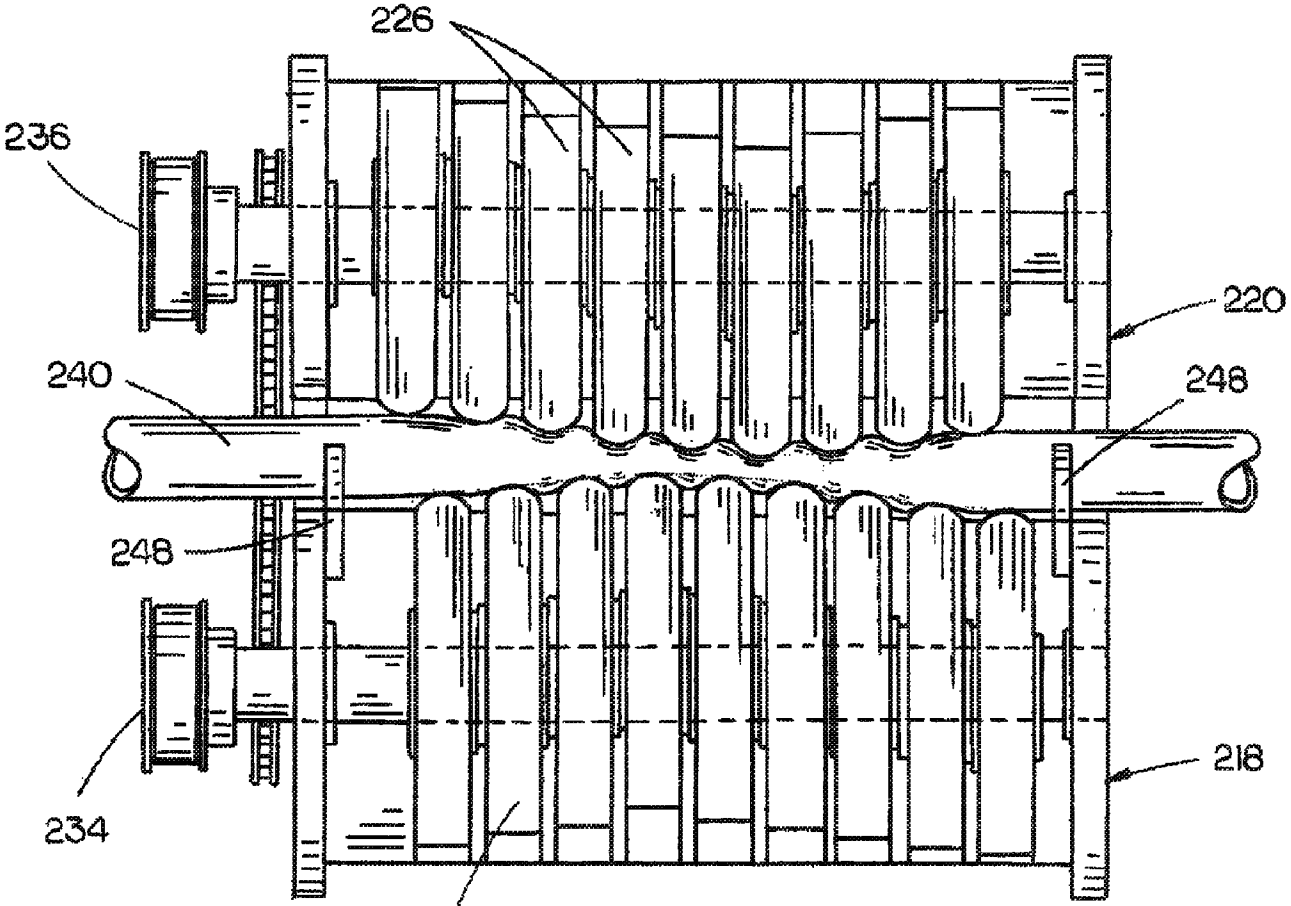
Figure 30:
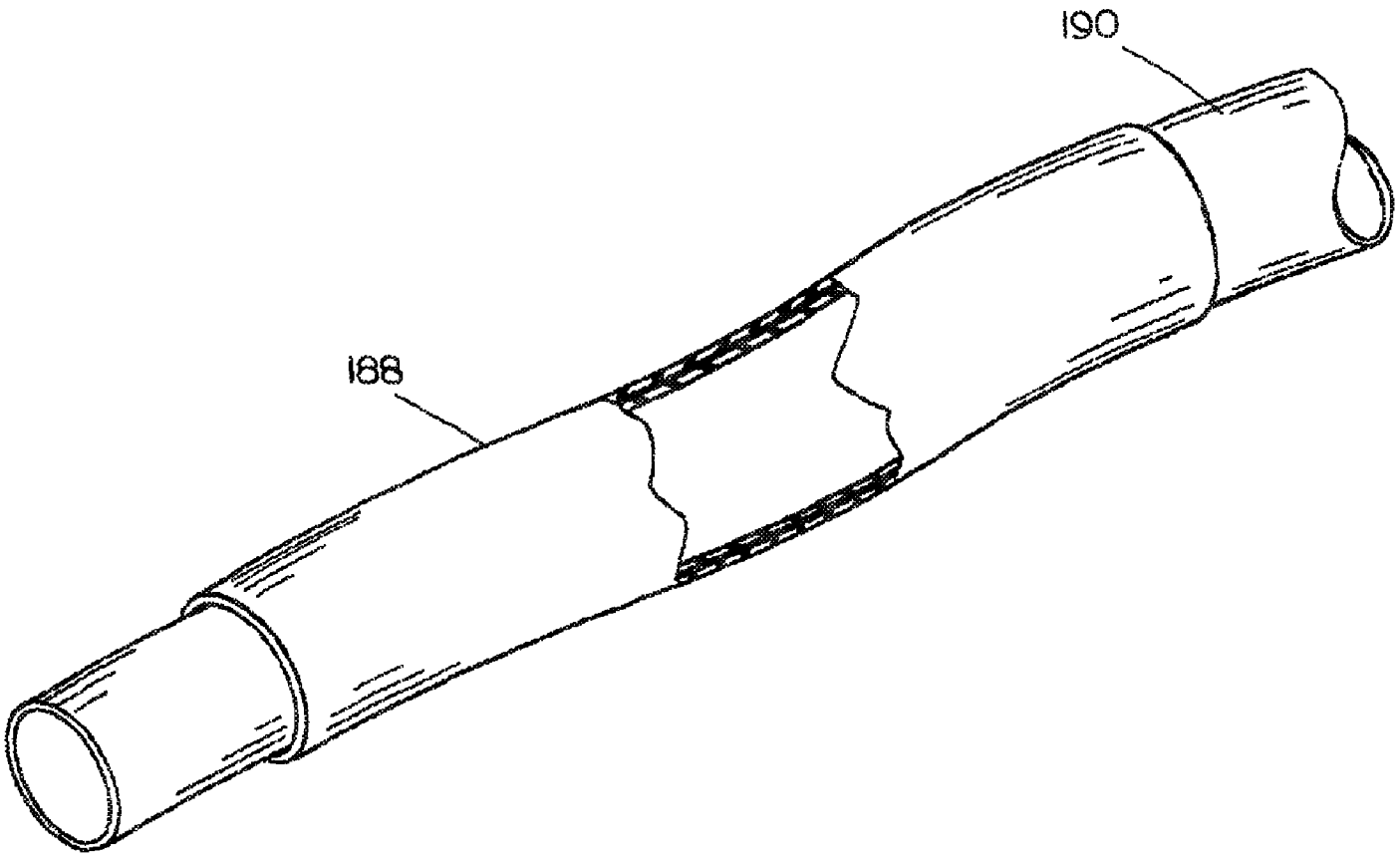

wherein it is illustrated that the invention accommodates transfer tubing of different diameters but substantially like wall thicknesses without altering the platens or pressure plates;

FIG. 24 is a perspective view of a bilateral peristaltic pump of the present invention illustrating a presently preferred opposing pressure plate configuration for increased improved pumping action in demanding industrial applications;

FIG. 25 is a perspective view of the bilateral peristaltic pump in an open position illustrating the drive assembly and opposing pressure plate configuration;

FIG. 26 is a perspective view of the bilateral peristaltic pump in an open position illustrating the transfer tube re-sizing collars and opposing pressure plate configuration of a presently preferred embodiment;

FIG. 27 is an end view of the bilateral peristaltic pump illustrating the adjustable latch assembly;

FIGS. 28A, 28B, and 28C are perspective views of various sample configurations of transfer tube re-sizing collars for allowing different sizes and numbers of transfer tubes to be accommodated;

FIG. 29 is a partial cross-sectional plan view of the bilateral peristaltic pump in operation illustrating the operation of the opposing pressure plates and the transfer tube; and FIG. 30 illustrates a pump contamination prevention embodiment of the present invention.

DETAILED DESCRIPTION

Figure 1:
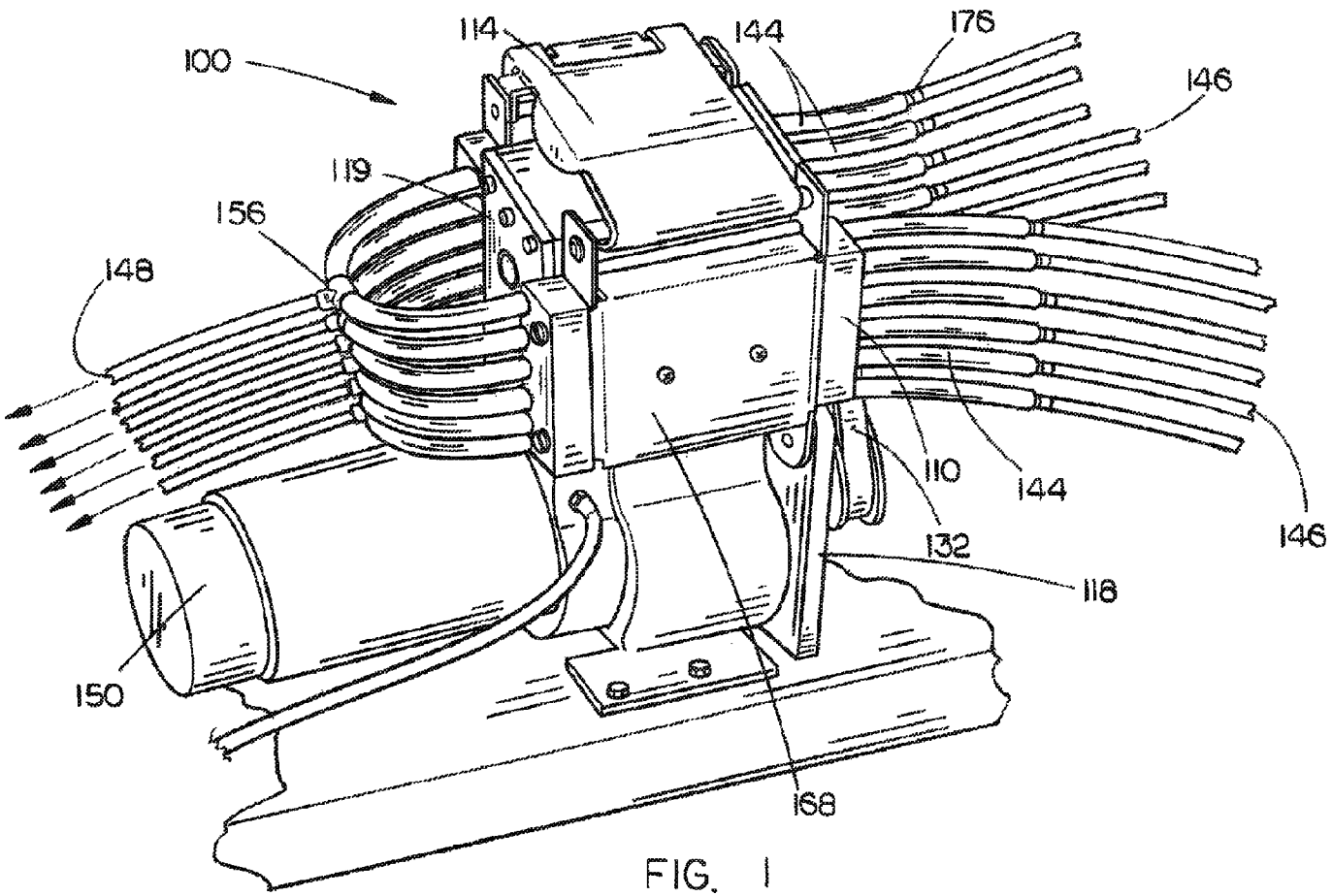
FIG. 1 is a perspective view of a multiple output mono-lateral peristaltic pump of the present invention illustrating a presently preferred dual sequenced pumping configuration for reducing output spurting and increasing pumping action.

The present invention may be generally configured in both mono-lateral (FIG. 1) and bilateral (FIG. 24) embodiments. It will be appreciated from the drawings and the description herein that many alternative embodiments are contemplated. FIG. 1 illustrates a mono-lateral peristaltic pump 100 of the present invention. The mono-lateral pump 100 includes a pump frame assembly (FIG. 2), which includes a plurality of pressure plates 106 (FIGS. 2, 5, 7 & 9) operatively housed in the frame (FIG. 2) in spaced apart parallel arrangement by pressure plate guides 104 (FIG. 8). The pump frame assembly includes a top plate 170, a bottom plate 172, and a pair of side plates 118 (FIG. 8). The top and bottom plates (170, 172) are retained in a dado (shown) or rabbet (not shown) 174 or other suitable joint (FIG. 8). It will be appreciated that the pressure plate guides 104 not only act as bearings and guides but also set the spacing between pressure plates 106 (0.5 to 5.0 mm is presently preferred).

Figure 7:
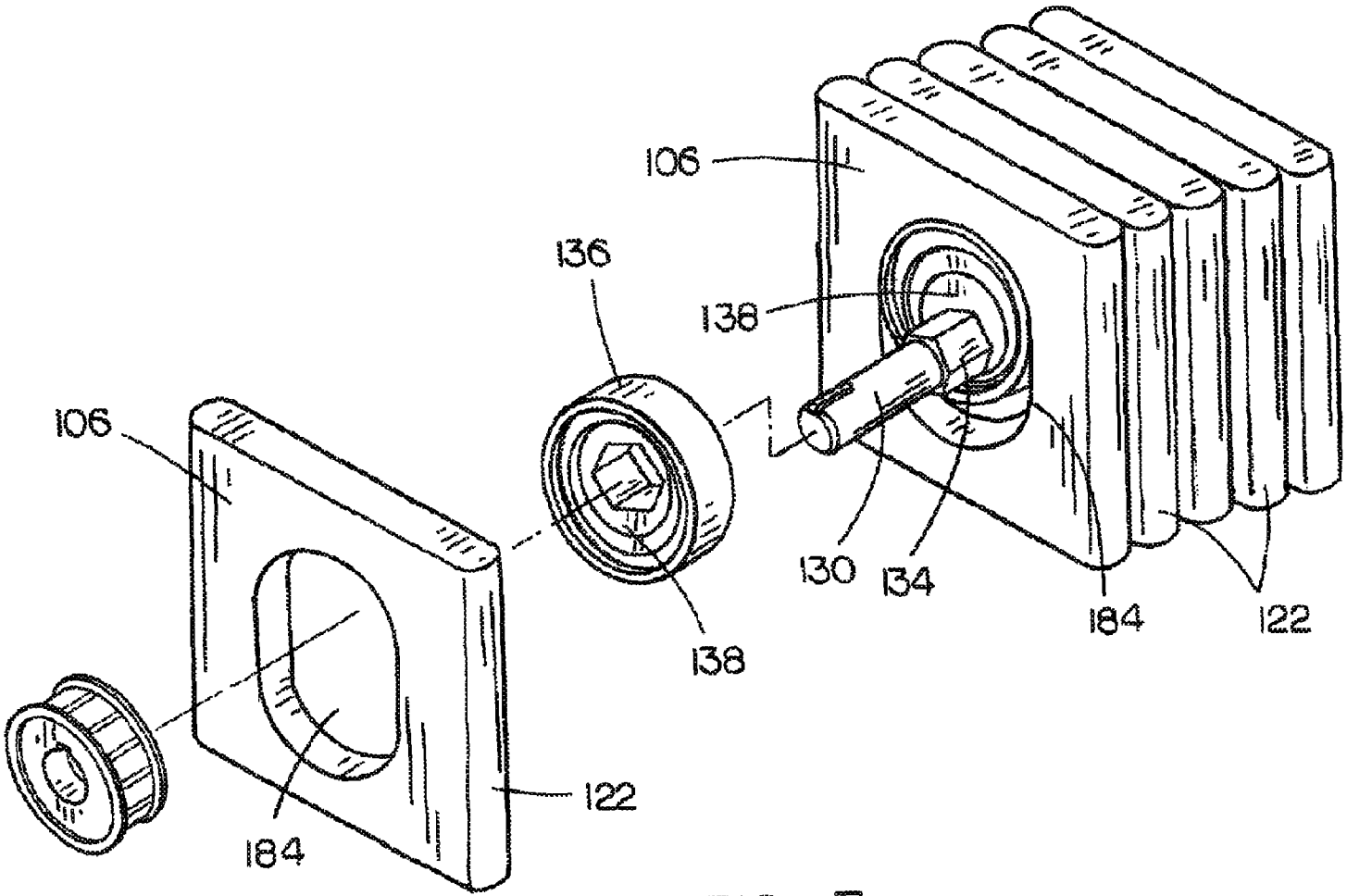
FIG. 7 is an exploded perspective view of a presently preferred pressure plate drive assembly illustrating the hex-drive of one embodiment of the present invention.
Figure 8:
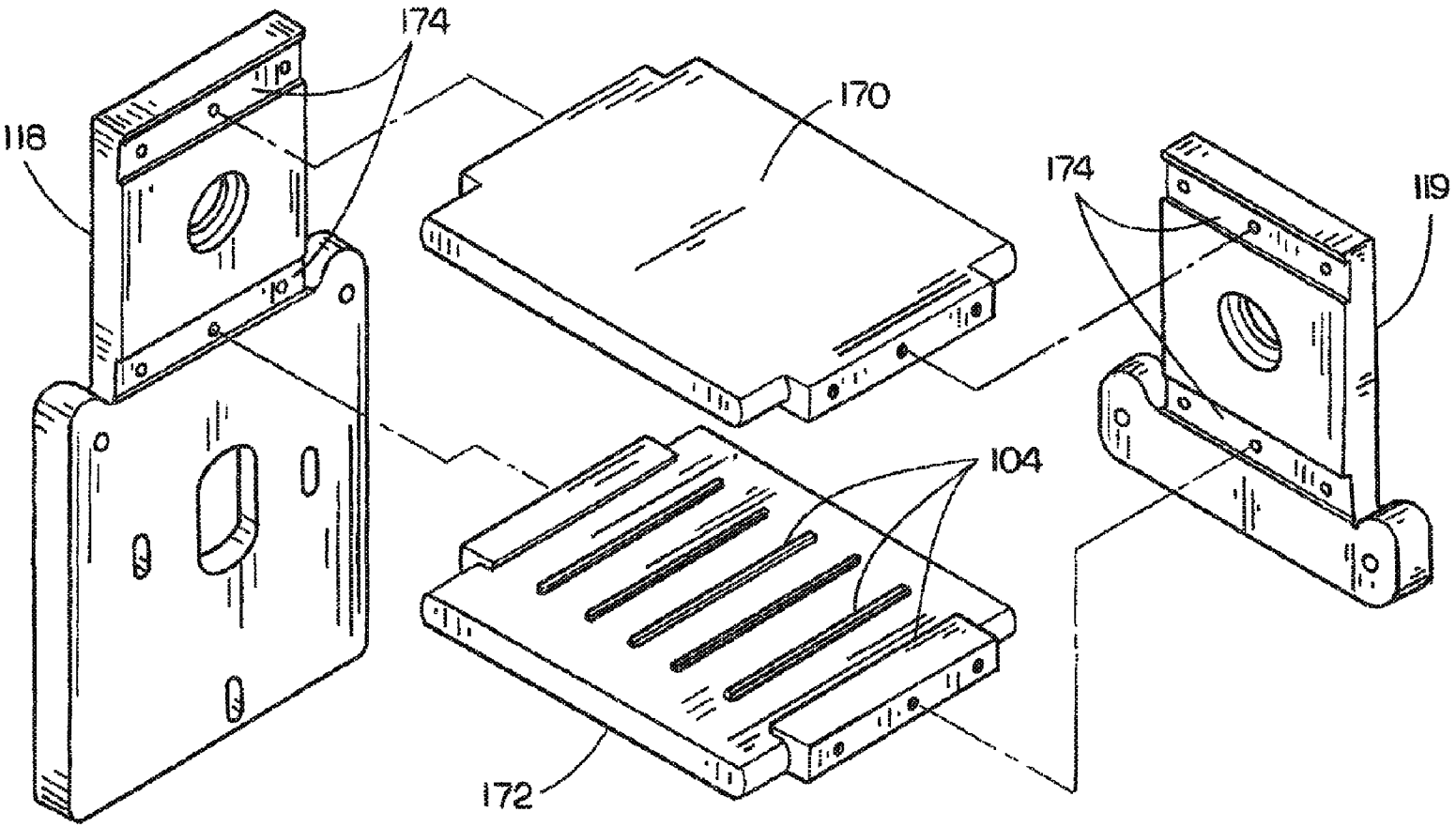
FIG. 8 is an exploded perspective view of a presently preferred pump frame assembly illustrating the pressure plate guides and a presently preferred frame construction.

The pressure plates 106 have radiused ends 122 (FIG. 7). The radiused ends 122 may have a radius of between one-half and five times the diameter of the transfer tube to be utilized. However, a radius approximating the transfer tubing diameter is preferred.

Figure 9:
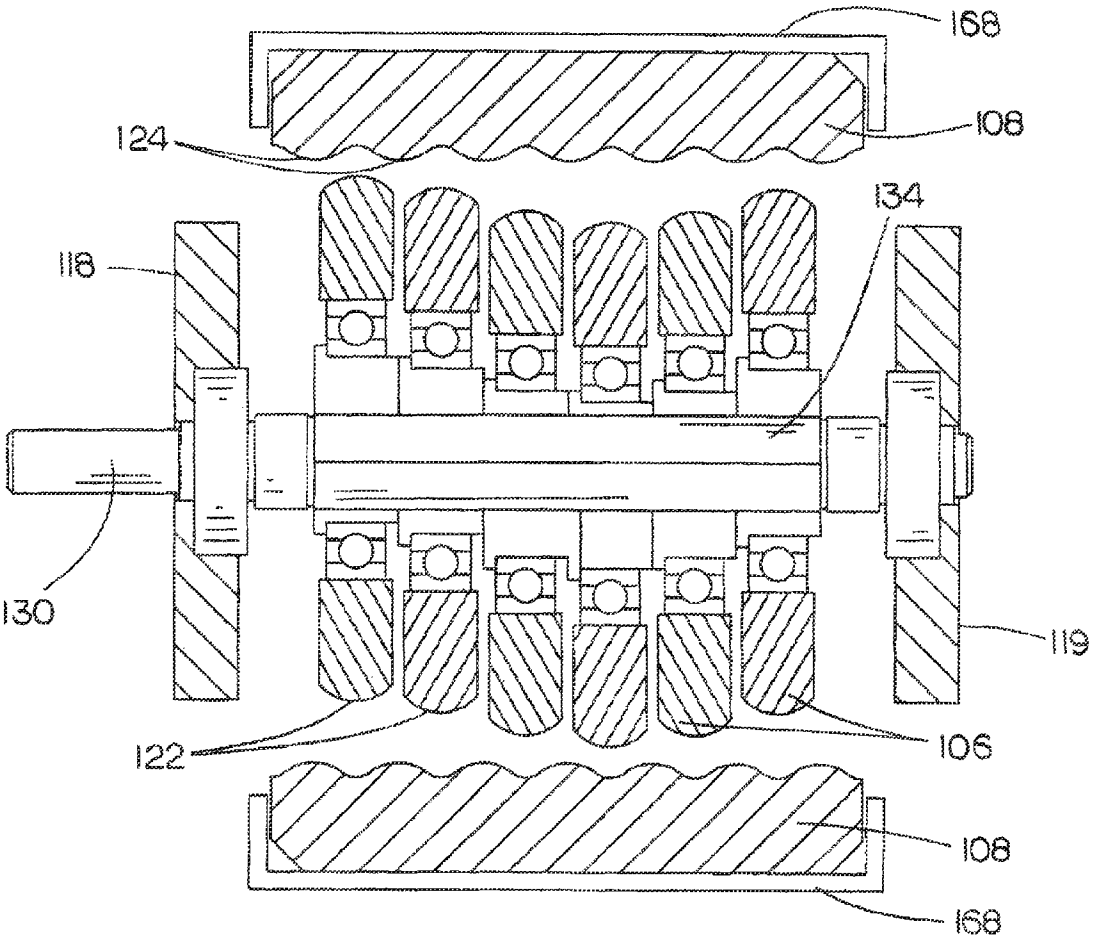
FIG. 9 is a top cross-sectional partial view of a mono-lateral peristaltic pump pressure plate drive assembly illustrating the serpentine pumping action and phase difference between opposing sides of the pressure plates and their respective platens.
Figure 12:
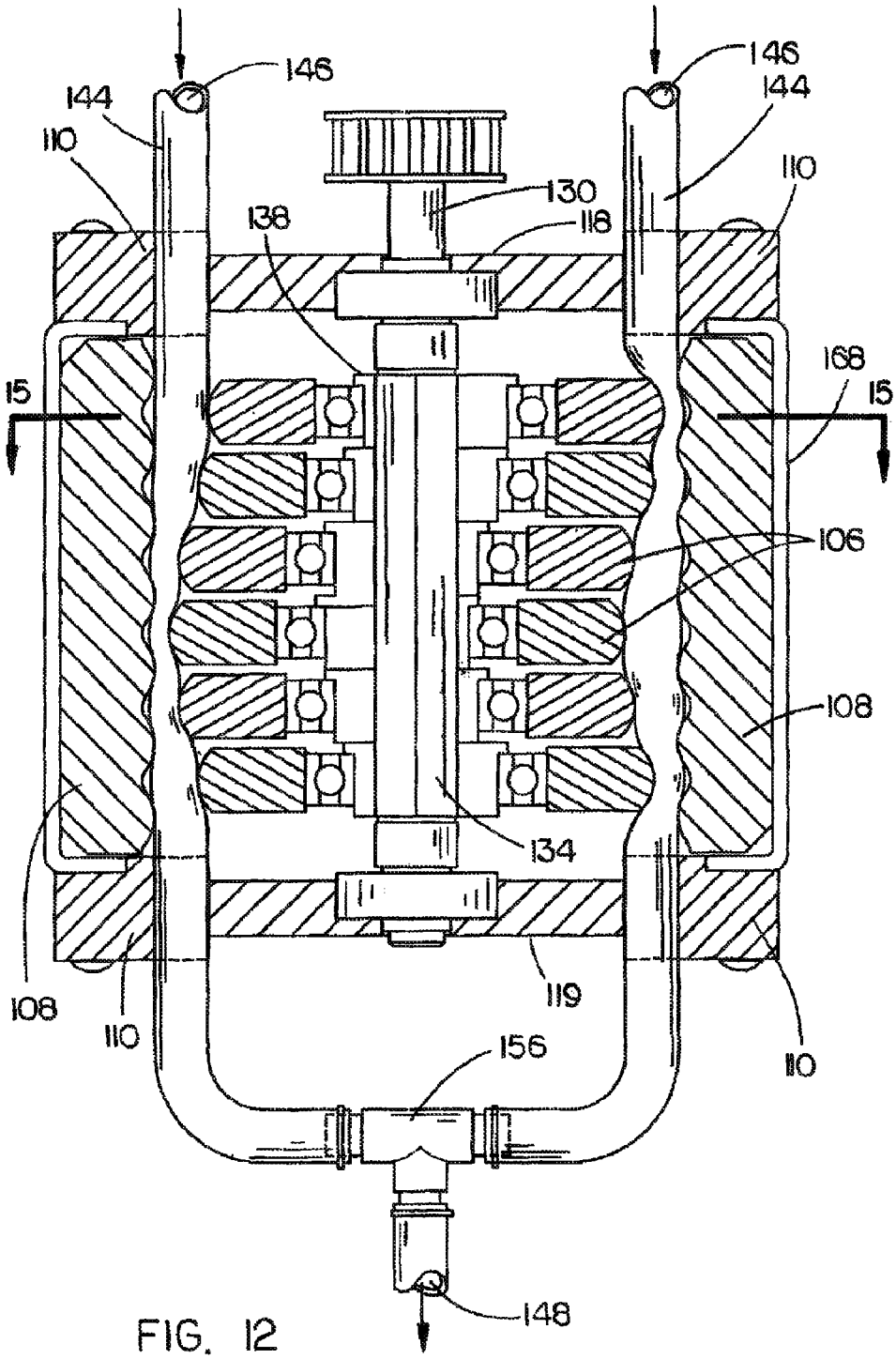
FIG. 12 is a top cross-sectional view of a mono-lateral peristaltic pump pressure plate drive assembly illustrating the serpentine pumping action and phase difference between opposing sides of the pressure plates and their respective platens and showing the transfer tubes occluded between staggered curved surfaces perpendicular to the tubes.
Figure 13:
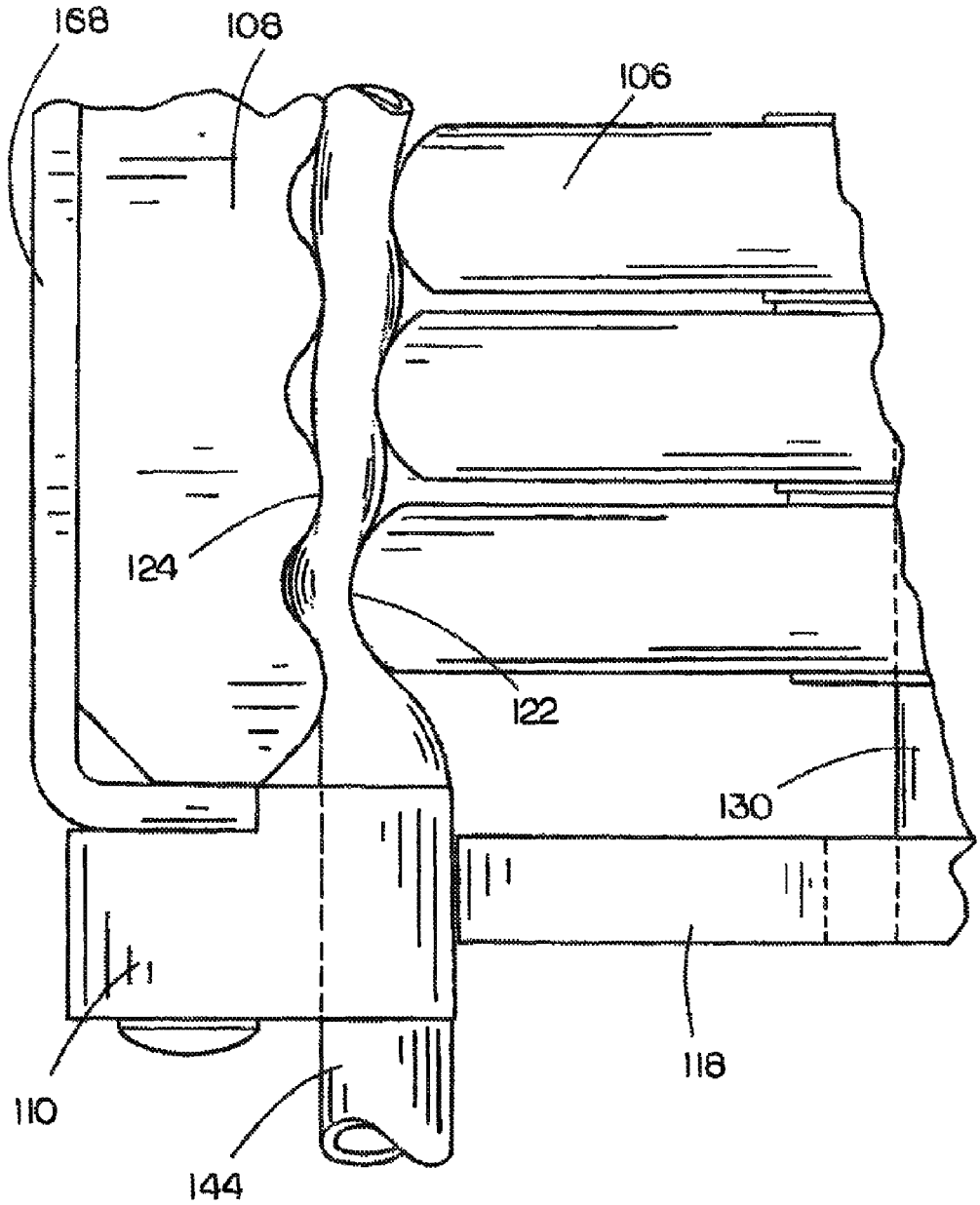
FIG. 13 is a partial schematic view of the pressure plate, transfer tube, and platen pumping action resulting from tube occlusions between staggered curved surfaces.
Figure 19B:
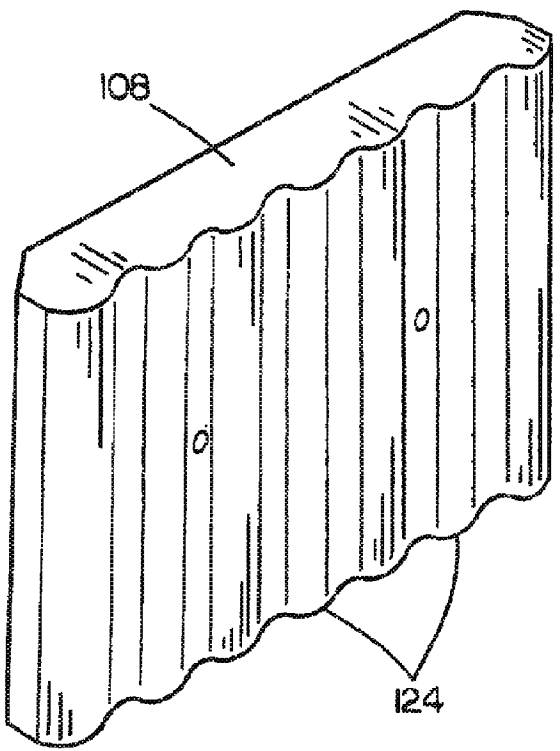
FIGS. 19A and 19B are perspective views of different platens illustrating different thickness configurations for controlling pump sizing.
Figure 19A:
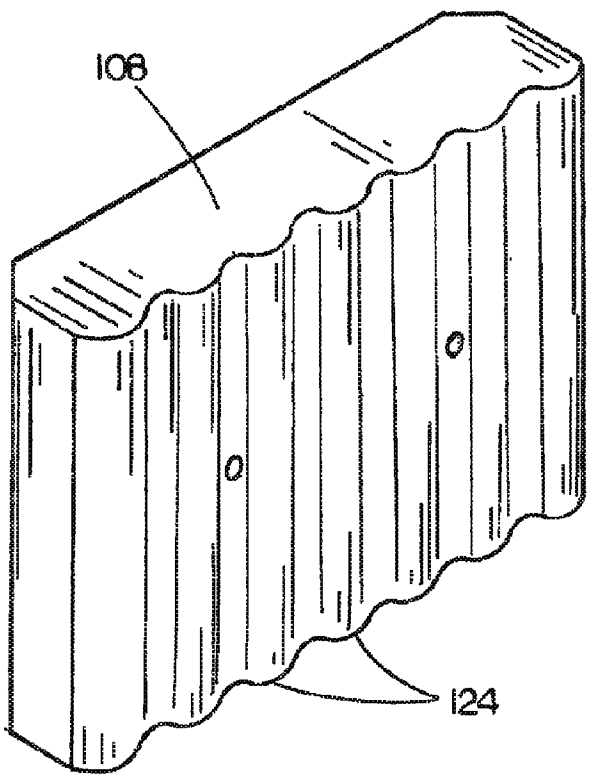

The pump frame assembly (FIG. 2) includes platens 108 having a plurality of curved surfaces 124 (FIG. 9). Platen guides 168 secure the platens 108 in opposed arrangement to the pressure plates 106. The configuration of the pump 100 may be altered to produce varying rates and pressures, by changing platens 108 and the like. For example, a platen 108 (FIG. 9) having a greater or lesser thickness may be utilized to accommodate different diameter transfer tubes 144 (FIGS. 19A & 19B). It will be appreciated that the platens in a preferred embodiment have a cross-sectional profile of a plurality of parallel curved surfaces which are perpendicular to the flow in the transfer tube of the pump. This results in an irregular surface which complementarily interacts with the curved ends 122 of the pressure plates106 (FIGS. 10A to 10F) so as to occlude (FIG. 12) the transfer tube 144 against the platen 108 between staggered curved surfaces (FIGS. 13 &

14) perpendicular to the transfer tube 144 in a wave sequence (FIG. 16) to promote a peristaltic pumping action.

Figure 14:
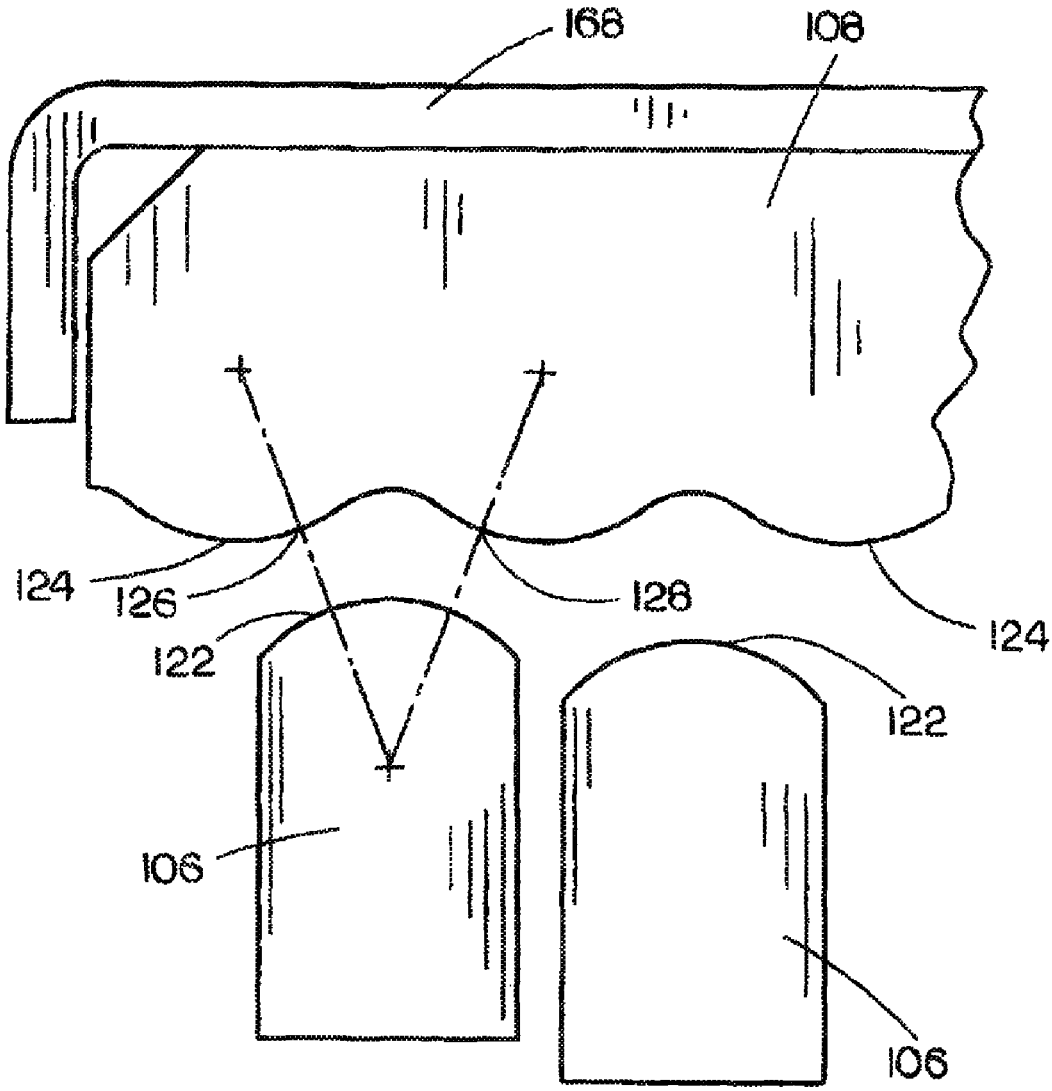
FIG. 14 is a partial schematic view of the pressure plate and platen configuration illustrating staggered curved surfaces of the pressure plates and the platen showing that there are two occlusion points on each curved surface.

The staggered curved surfaces of the pressure plates 106, and platen radiuses 124 interfaces produce a first and second occlusion point 126, 128 (FIG. 14). The two occlusions 126, 128 between staggered curved surfaces allow the pump to produce heretofore unobtainable linear peristaltic pump pressures and vacuums. Additionally, by occluding the pumping tube (transfer tube 144) between staggered curved surfaces (pair of occlusion points 126, 128) pump backflow is prevented. It will be appreciated that the pumps 100, 200 of the present invention, when configured in accordance with the recited preferred embodiment, are generally capable of producing a vacuum sufficient to raise a column of water 30 feet or a column of mercury 27 inches (approximately 70 Torr). Likewise, the recited pump configuration produces generally equal forces on the opposing sides of each transfer tube occlusion. This reduces transfer tube wear (delamination and the like) and heat in the transfer tubing. It will be recognized that heat and shear forces damage pumped cellular material such as blood and the like. Additionally, the pump 100 of the present invention produce a more even flow.

In a presently preferred embodiment the radiuses for the curved surfaces for various tubes are provided:

| Tube OD | Radius |
|---|---|
| 3/8 inch | 9/32 inch |
| 1/2 inch | 5/16 inch |
| 1 1/4 inch | 9/16 inch |

Collar 110 openings may be slightly undersized so as to better secure the transfer tubing 144.

Figure 20:
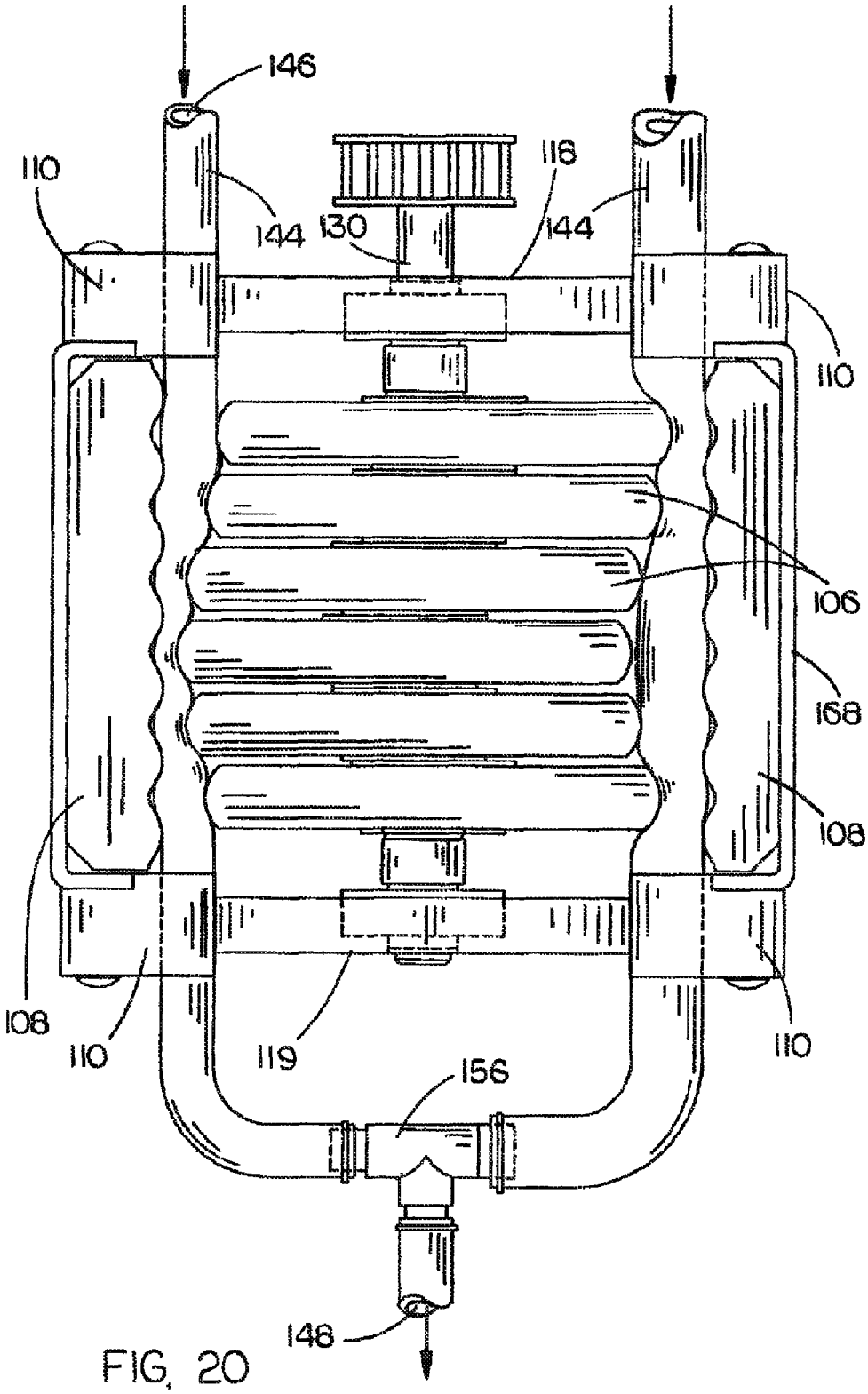
FIG. 20 is a top schematic view of a mono-lateral peristaltic pump utilizing two tubes of different diameters, diagrammatically illustrating the pump producing a pumped mixture of two fluids at different ratios.

In a preferred embodiment, the pump 100 is configured as shown in FIG. 1 with transfer tube collars 110. The collars 110 are adjustably mounted to the platen assemblies with collar fasteners 112 or the like. In operation, it is desirable to allow differently configured collars 110 to be utilized. For example, collars for more or fewer transfer tubes, different sized transfer tubes, or transfer tubes with differing retention requirements (tube stiffness, thickness, flexibility, memory, and the like). In operation, the pumps may be configured to pump and mix multiple materials at a specified ratio by utilizing transfer tubes of different sizes (FIG. 20) and/or a different number of transfer tubes for different materials (FIGS. 21, 22, 23, et al).

As shown in FIG. 1, the transfer tubes 144 may be of a different material than the input or output tubes 146 and 148. For example, in the mono-lateral pump 100 the transfer tubes may be joined to the input tubes 146 via connectors 176 and the output tubes 148 may be joined to pairs of opposing transfer tubes 144 via a T-connector 156. This configuration reduces spurting (non-continuous) flow as the two sides of the mono-lateral pump are out of phase (FIGS. 12, 15, 16, & 17). This reduction in flow pulsation without a pressure and rate restricting pulse dampener is unique. It will be appreciated from the schematic diagram of FIG. 17 that the pumped portions 178, 180 are generally joined 182 together at the T-connector 156. This allows for more consistent, reliable and controllable rates of delivery.

Figure 2:
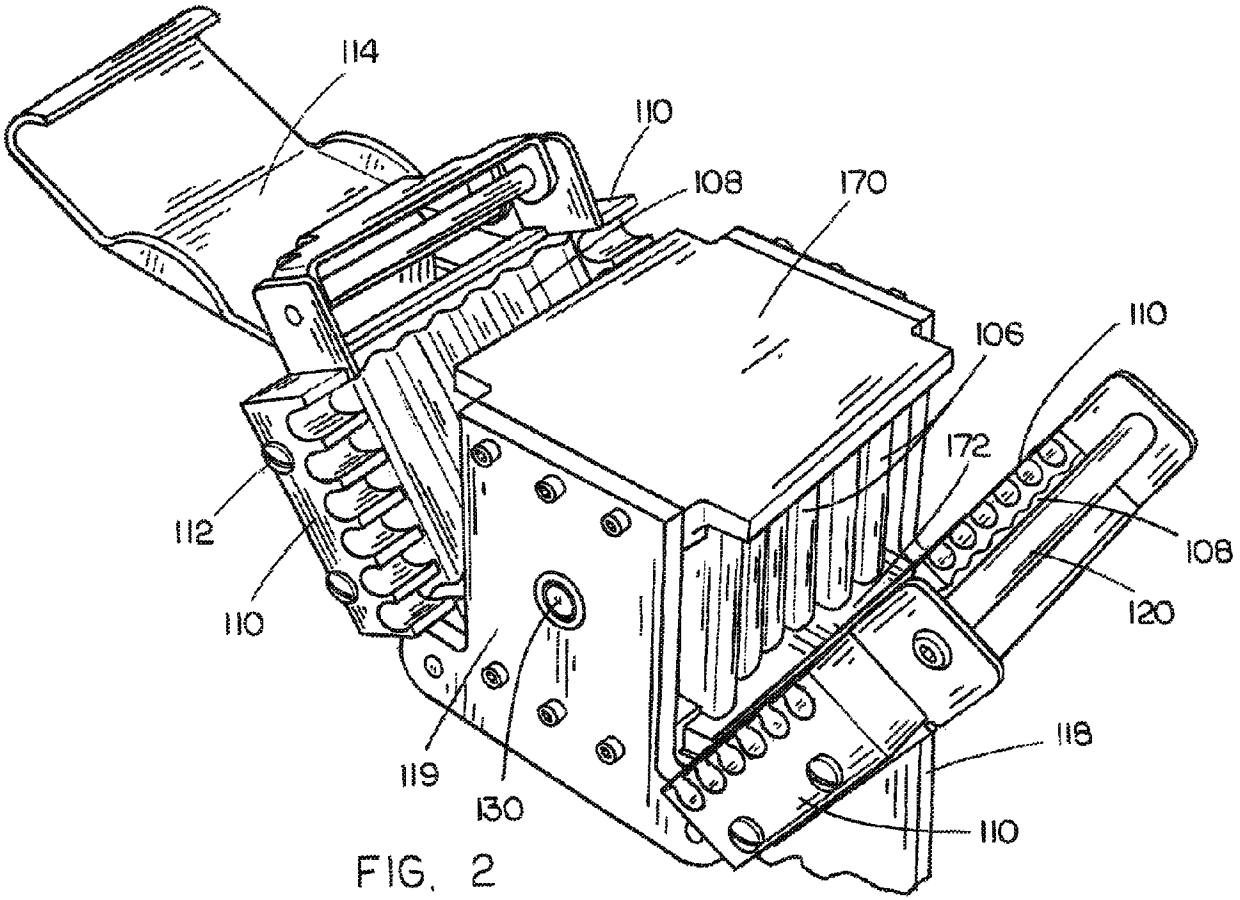
FIG. 2 is a partial perspective view of a multiple output mono-lateral peristaltic pump in an open position illustrating the pressure plates, platens, pump tube collars, and presently preferred latching mechanism.
Figure 3:
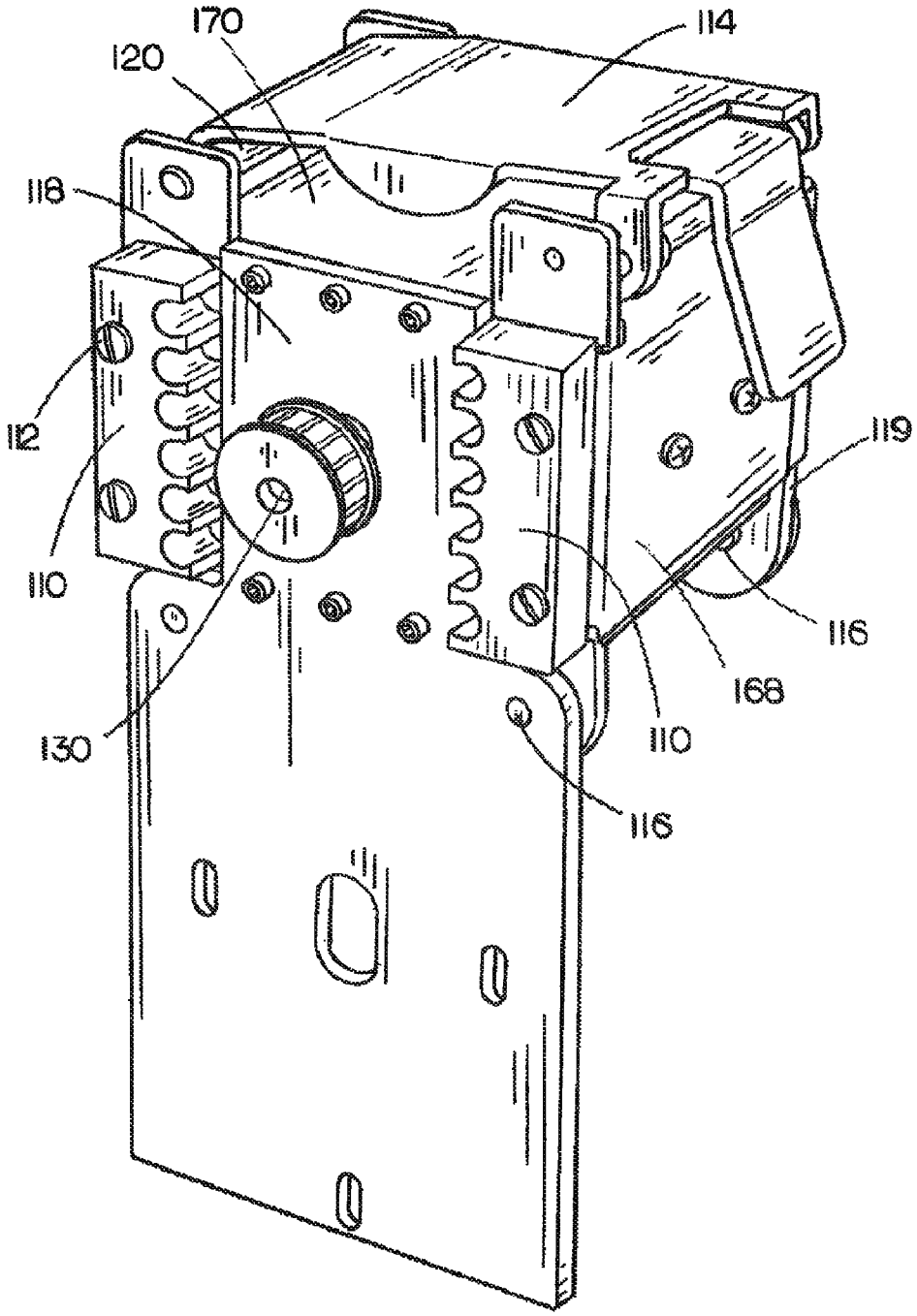
FIG. 3 is a perspective end view of a multiple output mono-lateral peristaltic pump in a closed position illustrating a preferred pump frame assembly and motor mount configuration.
Figure 4:
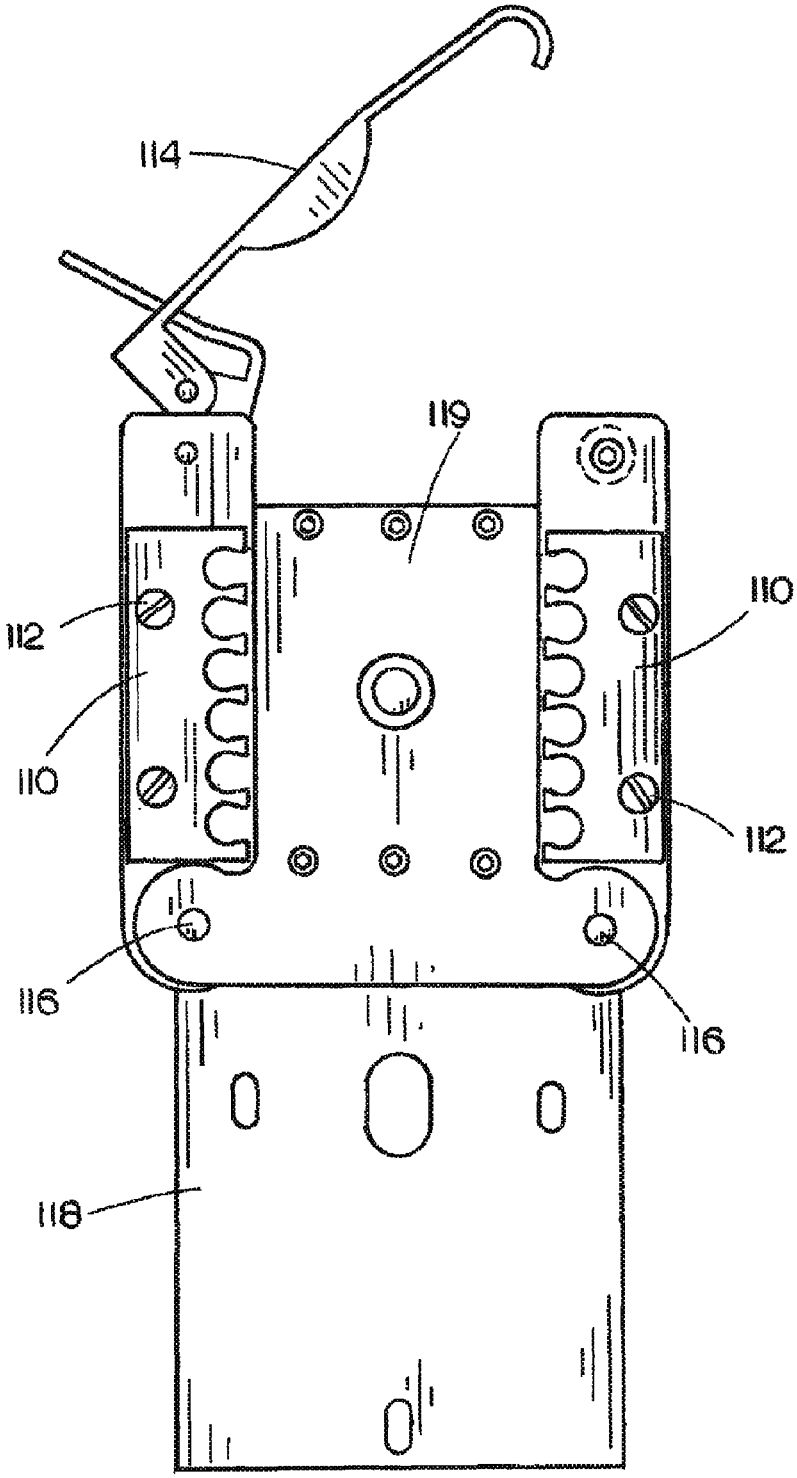
FIG. 4 is a front elevation view of a multiple output mono-lateral peristaltic pump where the latch mechanism is in an unfastened position.
Figure 5:
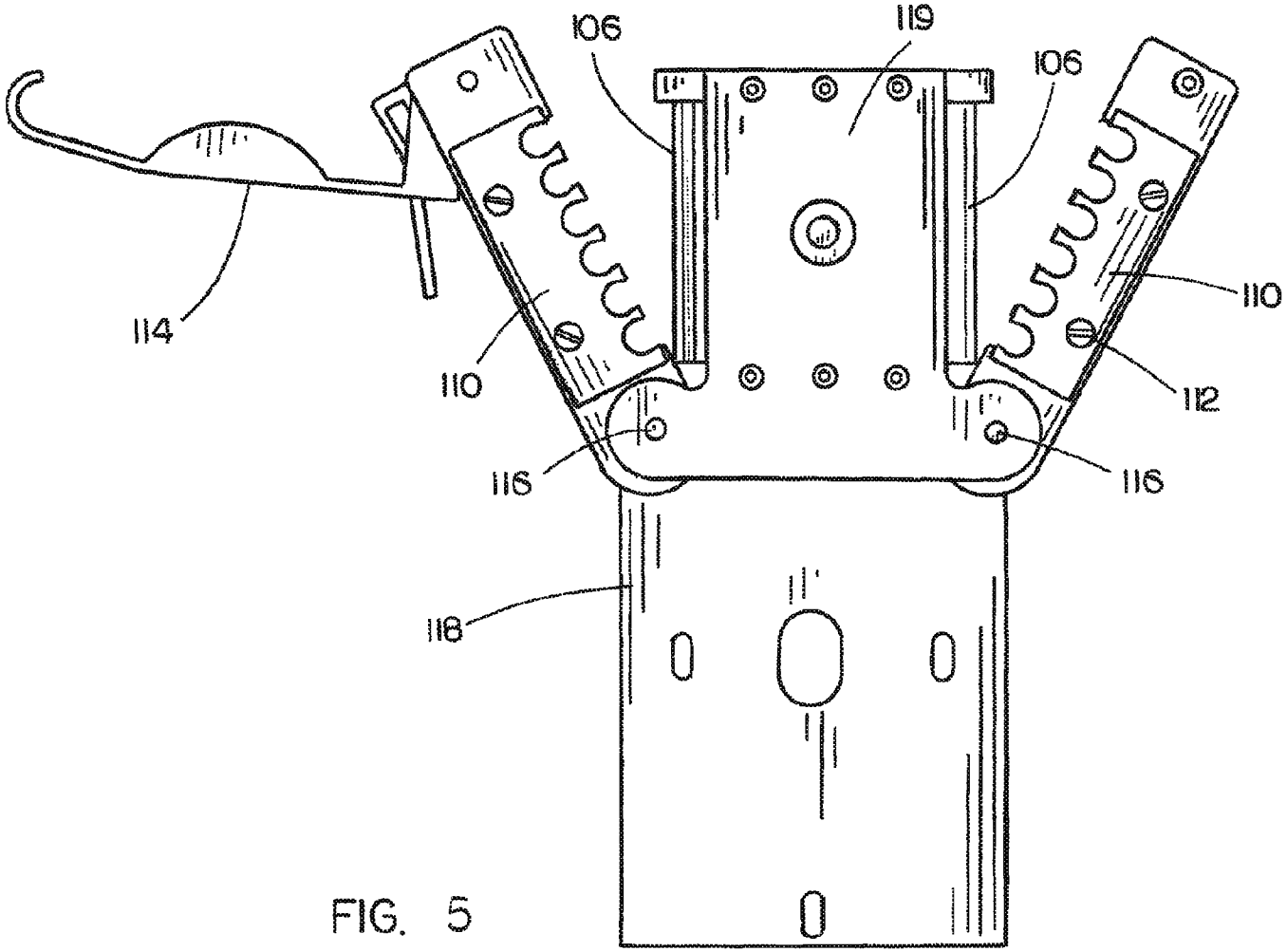
FIG. 5 is a front elevation view of a multiple output mono-lateral peristaltic pump where the pump is in an open unlatched position.

FIG. 2 illustrates the mono-lateral pump 100 unlatched and in an opened position ready to accept transfer tubes 144. The latch 114 secures both platens 108 in a spaced apart configuration opposing the pressure plates 106 via the latch pin 120 and pivot pins 116 (FIG. 3). The transfer tubes are secured between the collars 110 and the assembly is latched (FIG. 3). As the drive shaft 130 (FIG. 3) is rotated via the motor 150 and drive mechanism 132 (FIG. 1) the pressure plates 106 move in a peristaltic wave (FIGS. 10A to 10F). Limiters 142 (FIG. 15) control the angle the platen assemblies are allowed to open (FIGS. 2 & 5).

Figure 11A:
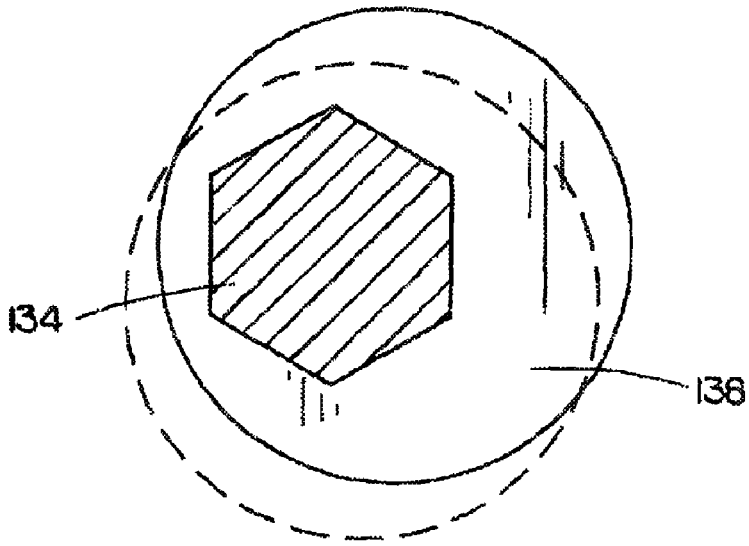
FIGS. 11A and 11B are cross-sectional end views of the geometric-drive system of the present invention (in a hexagonal configuration) wherein FIG. 11A schematically illustrates eccentric shift in a ⅙ rotational interval and FIG. 11B schematically illustrates the eccentric shift in a full rotation at ⅙ intervals (as illustrated by FIGS. 10A-10F)
Figure 11B:
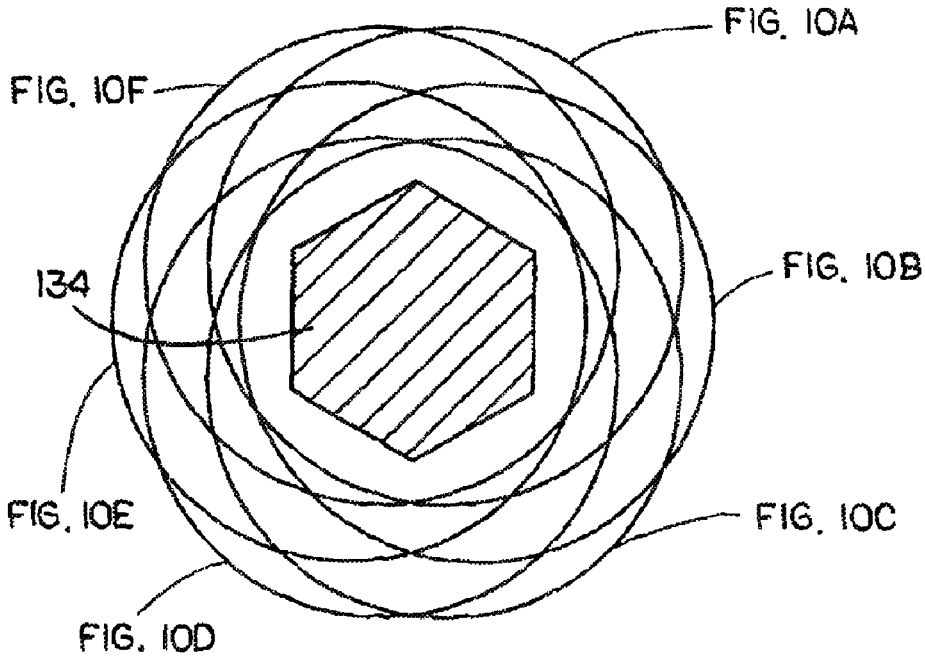
Figure 15:
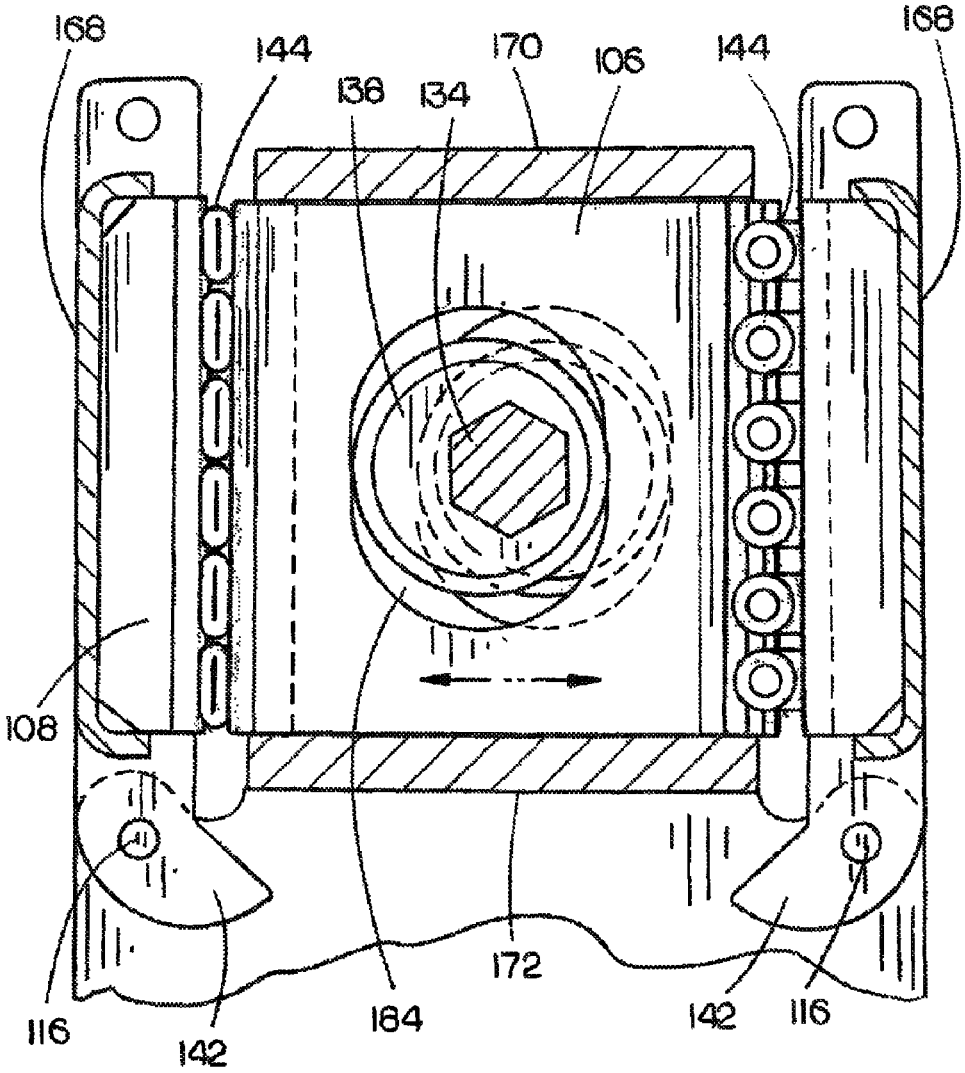
FIG. 15 is a partial cross-sectional end view of the geometric drive assembly of the present invention wherein the phase difference between the first side and the second side of the pump are illustrated as indicated by cross-section arrows on FIG. 12.
Figure 16:
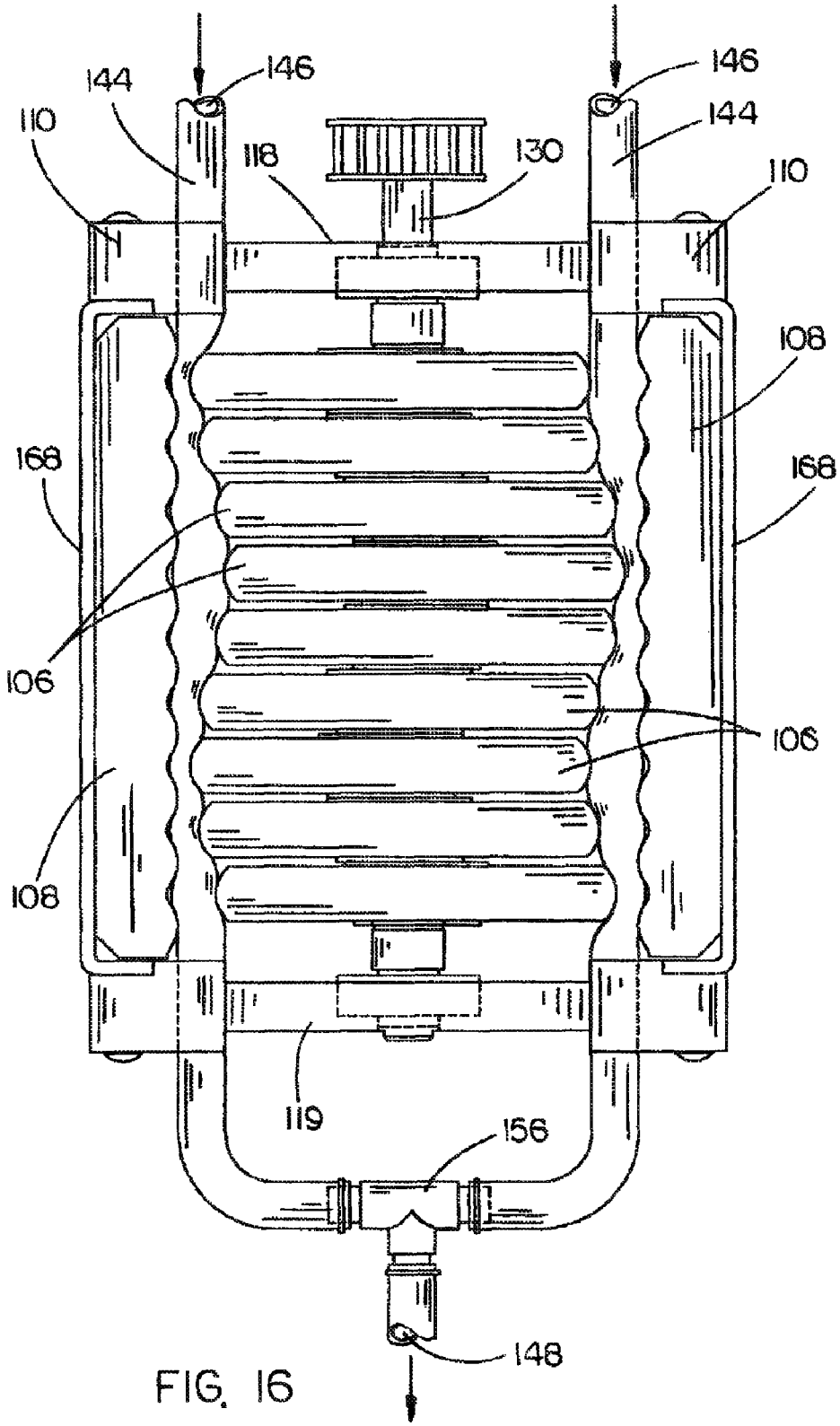
FIG. 16 is a top cross-sectional view of a mono-lateral peristaltic pump pressure plate drive assembly illustrating the serpentine pumping action and phase difference between opposing sides of the pressure plates and their respective platens showing the transfer tubes occluded between staggered curved surfaces perpendicular to the tubes in a nine pressure plate overlapping 1.5 rotation increased pressure configuration.
Figure 17:
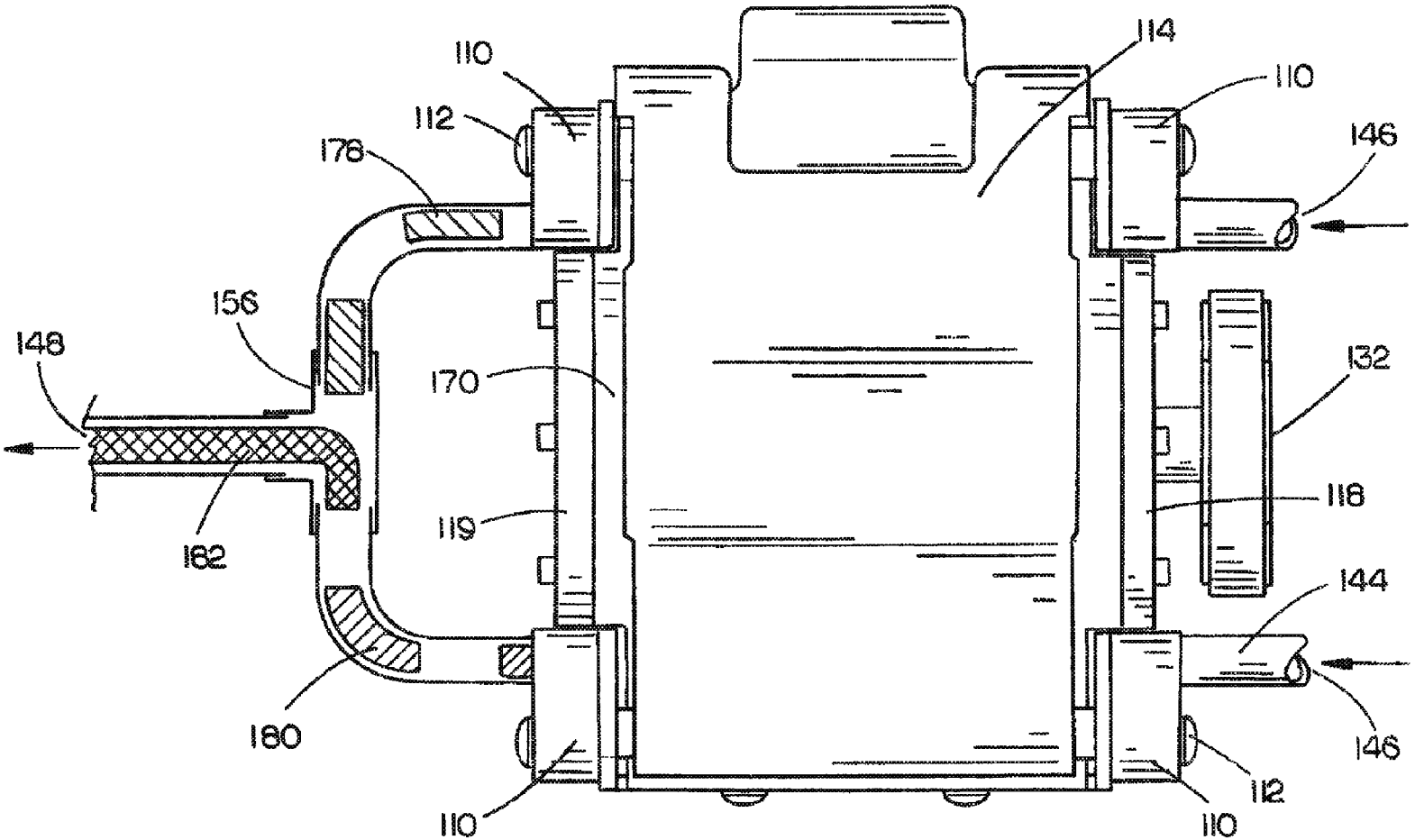
FIG. 17 is a top schematic view of a mono-lateral peristaltic pump diagrammatically illustrating the joined flow of the outputs on either side of the pump for reducing output spurting in flow and overall pumping variance.

FIG. 7 illustrates a preferred pressure plate 122 drive assembly. Each pressure plate 106 has an elliptical shaped void 184. The drive shaft 130 includes a hex drive portion 134 and a pressure plate bearing 136 for each pressure plate 106. Each pressure plate bearing 136 has an eccentric insert 138 with a hexagonal void which is driven by the drive shaft 130 to perform the oscillation of the pressure plates (FIGS. 11A & 11B). The pressure plate 106 voids 184 are then utilized to drive the pressure plates 106 in a reciprocal motion in a wave sequence (FIGS. 15 & 16).

Figure 6:
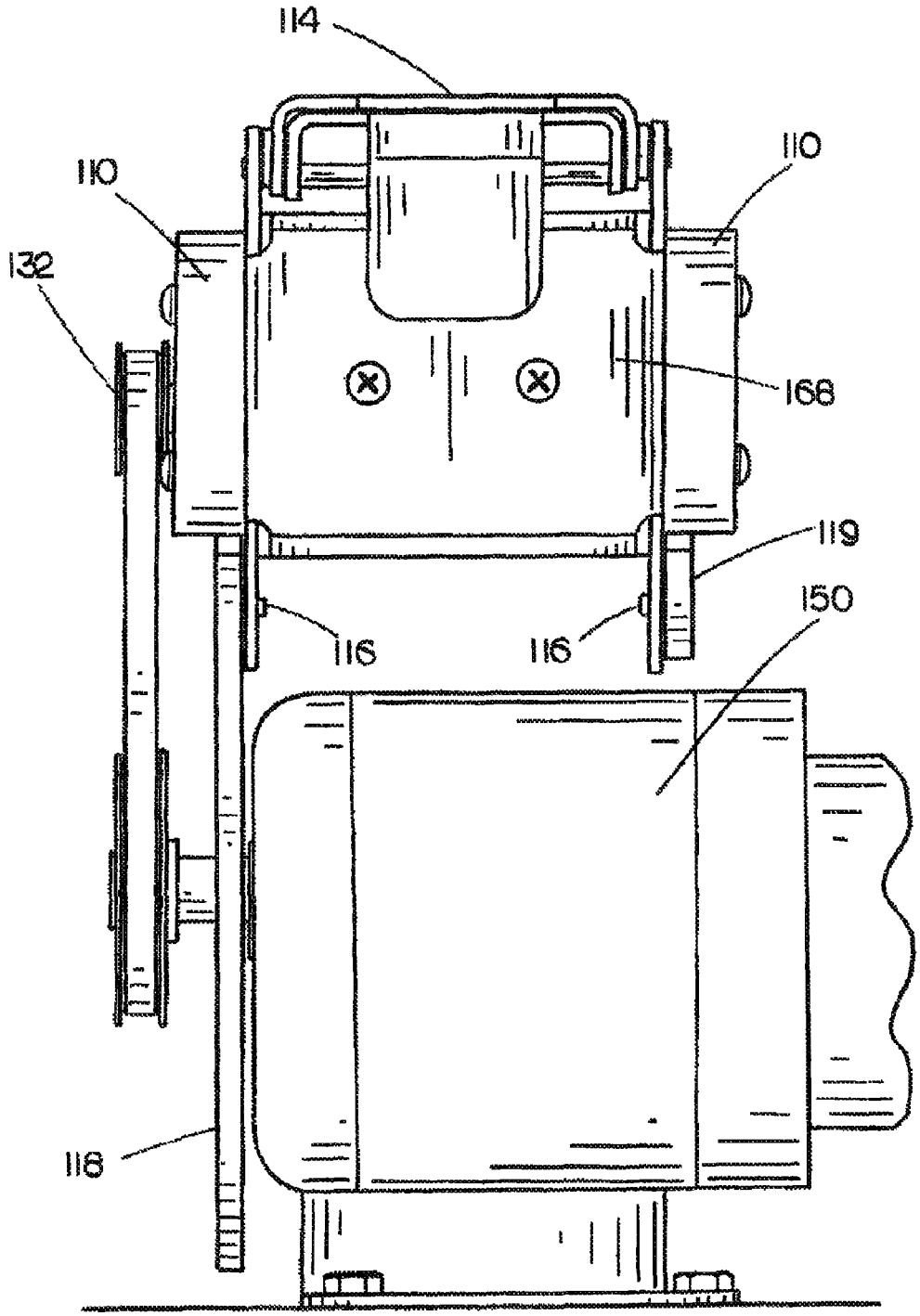
FIG. 6 is a side elevation of a multiple output mono-lateral peristaltic pump illustrating a presently preferred drive and mounting configuration.

FIG. 6 illustrates a presently preferred pump belt drive and mounting configuration. It is anticipated that reduction gears, chains, direct drive, stepper motor drive and the like may also be utilized.

Figure 18A:
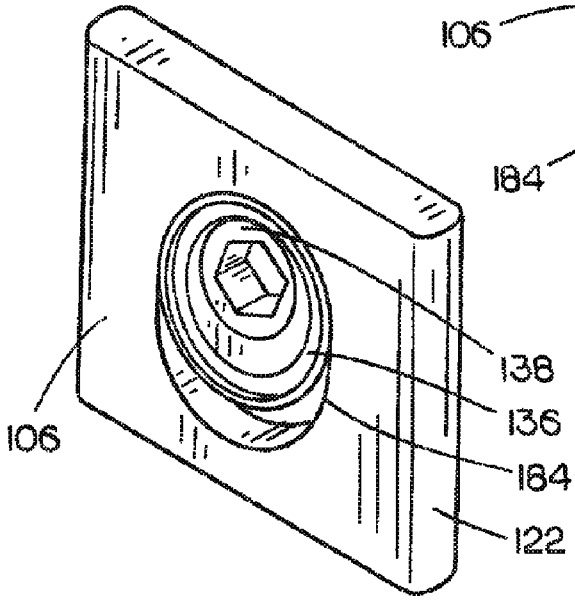
FIGS. 18A, 18B, and 18C are perspective views of three means for adjusting a presently preferred embodiment of the present invention to different outputs by configuring the pressure plates differently (tube diameters and tube wall thicknesses) wherein 18A utilizes a longer pressure plate, 18B utilizes a larger eccentric, and 18C utilizes different pressure plate end radiuses.
Figure 18B:
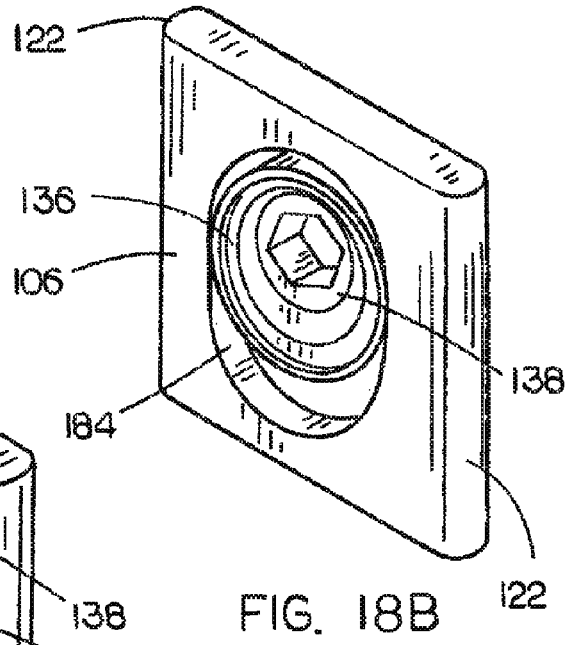
Figure 18C:
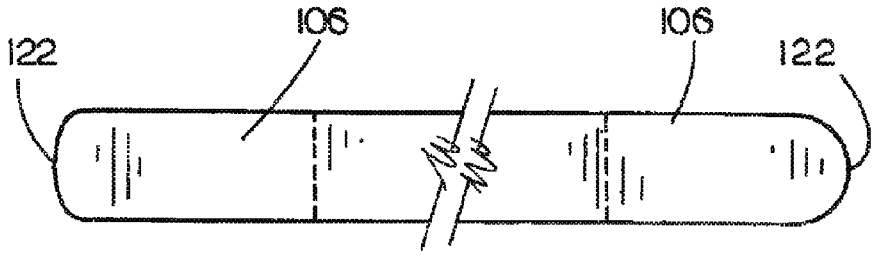

FIGS. 18A & 18B illustrate means for adjusting pump characteristics, for example, altering the size of the elliptical void 184, increasing the length of the pressure plates 106, increasing the width of the pressure plates 106, changing the eccentric 138, or the like. FIG. 18C illustrates different radiuses 122 on a pressure plate 106.

Figures 21A, 21B, 21C, 22A, 22B, 22C, 23A, 23B, 23C:
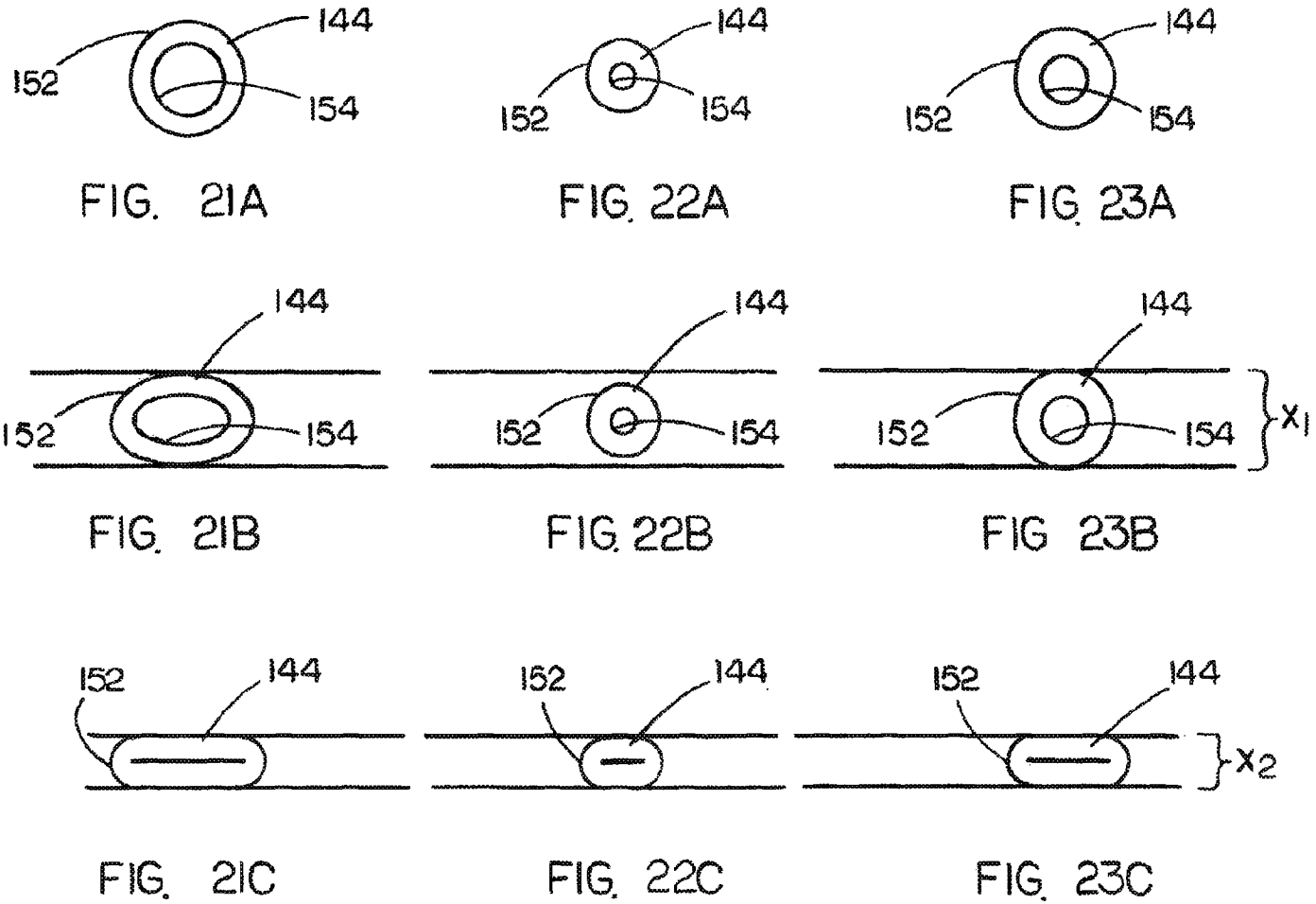
FIGS. 21A, 22A, and 23A are schematic end views of transfer tubing having different diameters (ODs) and interior diameters (IDs) but having the same wall thickness.
FIGS. 21B, 22B, and 23B are schematic end views of un-occluded transfer tubing of different sizes, but substantially the same wall thicknesses, between an opposing pressure plate and platen, the plate and platen spaced apart by a distance x1.
FIGS. 21C, 22C, and 23C are schematic end views of occluded transfer tubing of different sizes, but substantially the same wall thicknesses, between an opposing pressure plate and platen, the plate and platen spaced apart by a distance x2.

FIGS. 21A, 22A, and 23A illustrate transfer tubes 144, having different outer diameters 152 and different inner diameters 154, but all with generally the same wall thickness. FIGS. 21B, 22B, and 23B illustrate the cross-sectional configuration of transfer tubes having like wall thicknesses but different outer diameters in a non-occluded (open) position. FIGS. 21C, 22C, and 23C illustrate the cross-sectional configuration of transfer tubes having like wall thicknesses but different outer diameters in an occluded (closed) position. Those skilled in the art will recognize the adaptability of the present pump to accommodate varying sizes of transfer tubing without adjustment to the platen or pressure plates.

FIGS. 24 to 29 illustrate components of a bilateral embodiment of the peristaltic pump 200 of the present invention. In the bilateral embodiment 200 platens are not required. Opposing pairs of pressure plates 226 push against opposite sides of a transfer tube 240 (FIG. 24).

FIG. 24 illustrates the bilateral pump 200 in a closed and ready for operation configuration. The pump 200 includes a frame 202 consisting of a main pressure plate assembly frame 218 and a secondary pressure plate assembly frame 220 (FIG. 25). Each of the first and secondary pressure plate assembly frames 218, 220 include a plurality of pressure plates 226. The pressure plates are guided and maintained in an operative spaced apart parallel arrangement via a plurality of pressure plate guides 204 shown in FIGS. 24, 25 and 26 (not shown, FIG. 29, illustrated by 104, FIG. 8).

As illustrated in FIGS. 25 and 26, the bilateral pump 200 secondary pressure plate assembly may be swung open so as to allow transfer tube(s) to be loaded. The two pressure plate assemblies 218, 220 are hinged about pivot pin 216 (and drive spindle) (FIG. 25). The two pressure plate assemblies are held in operating position via an adjustable latch mechanism 214, 222, 224 (FIG. 27). The distance between the two pairs of opposing pressure plates may be adjusted to accommodate change in occlusion on the transfer tubes. Additionally, the amount of compressive force applied to a given diameter of tubing may be adjusted via the latch adjustment mechanism 224 (FIG. 25). The transfer tube(s) 240 are retained via a pair of collars 248 (FIGS. 26 & 28A, 28B, & 28C). The collars 248 may be readily removed and replaced with collars designed to accommodate different tubing types (FIGS. 28A, 28B, & 28C).

FIG. 25 illustrates the drive assembly 234, which includes a motor 246, main drive assembly 234, and secondary drive assembly 236. The pressure plates 226 are driven in a preferred embodiment in the same manner as in the mono-lateral pump 100 (FIG. 7). FIG. 29 best illustrates the peristaltic pumping action of the opposing pressure plates.

FIG. 30 illustrates a preferred means for preventing pump contamination in the event a transfer tube 140, 240 ruptures. In such a configuration the safety tubing 188 acts as a sleeve around the protected transfer tube 190. In operation both ends of the safety tubing 188 may be placed into tube rupture reservoirs (not shown). If a transfer tube ruptures its contents are dispersed between the outer diameter of the protected transfer tube 190 and the safety tubing 188 and then flow into tube rupture reservoirs. Safety tubing 188 can be utilized in this linear pump configuration because there is no rolling action of the tube and minimal linear pull on the tube.

The preferred materials for the pressure plates, platens, and collars are either machined Delrin® (Acetal-(PolyOxy-Methylene)) or molded Ultra-High Molecular Weight Polyethylene (UHMW-PE). Transfer tubing is preferably Masterflex® Norprene, or a like Masterflex® tubing selected for the required application. The metal components are preferably manufactured from machined or cast aluminum and stainless steel laser-cut components.

It should also be appreciated that: (1) The eccentrics (cams) 138 (FIG. 7) on the drive shaft 130 manipulate a single set of pressure plates 106 with two opposing sets of curved surfaces in cooperation with two platens 108 (with curved surfaces which are staggered in relationship to those of the pressure plates 106) will occlude two separate transfer tubes in opposition to each other in occlusion, and where, when the two transfer tubes are joined on the output, a near constant flow of the pumped fluid is produced; (2) The drive shaft 130 eccentrics (cams) 138 are in a spiral form over the length of the powered shaft whereby the transfer tubes are occluded in a wave pattern over the staggered curved surfaces to promote flow within the transfer tubes; (3) The present pump promotes laminar flow and minimizes turbulence within the fluid being pumped; (4) The transfer tube(s) may be replaced without affecting occlusion settings; (5) The present pump minimizes tubing shear stresses; (6) The present invention prevents rolling of the transfer tube during pumping; and (7) As shown in FIGS. 16 and 29, greater than six pressure plates, for example, nine pressure plates producing an overlapped cycle (1.5 cycles per rotation) may be utilized to improve the performance of the pump for pressure (or suction).

The invention claimed is:

1. A peristaltic pump, comprising:

a pump frame;

a platen operatively associated with said pump frame, the platen having a series of parallel curved surfaces disposed parallel to each other in the direction of flow through the pump, and where each curved surface extends out from the platen and is perpendicular to the flow of the pump;

a pressure plate assembly including a plurality of pressure plates, each one of the plurality of pressure plates disposed generally parallel to the curved surfaces of the platen and perpendicular to the direction of flow through the pump, each one of the plurality of pressure plates is configured for translational motion in the direction of the platen, wherein said pressure plates are spaced one from another and each one of the plurality of pressure plates includes an end curved surface extending generally in the direction of the platen and centered on a space between two curved surfaces of the platen;

at least one transfer tube sandwiched between the platen and the pressure plate assembly in the direction of flow;

a drive assembly operatively associated with said pump frame and said pressure plate assembly, the drive assembly for driving said plurality of pressure plates in a wave sequence so as to sequentially occlude portions of the at least one transfer tube corresponding to the adjacent center between the curved surfaces on the platen and to promote a peristaltic pumping action in said at least one transfer tube;

said pressure plates having a first and second side and a second radiused end; and a second platen in operational association with said second radiused end of said pressure plates.

2. A peristaltic pump, comprising:

a pump frame;

a platen operatively associated with said pump frame;

at least one transfer tube having a wall thickness, an inside diameter, and an outside diameter;

a pressure plate mounted in said pump frame so as to occlude said transfer tube against said platen between staggered curved surfaces perpendicular to said at least one transfer tube in a wave sequence to promote a peristaltic pumping action in said at least one transfer tube;

said platen characterized by a surface having a periodical plurality of curved surfaces opposed to and in a staggered relationship to and substantially corresponding to said pressure plate;

a drive assembly operatively associated with said frame, platen, at least one transfer tube, and said pressure plate, and one set of cams on a common shaft, for driving said pressure plate in a wave sequence perpendicular to said at least one transfer tube so as to sequentially occlude said at least one transfer tube between said staggered curved surface, wherein said cams are mounted on said shaft in a spiral configuration so as to drive said pressure plate in a wave sequence of occlusion along a restricted length of said at least one transfer tube; and said pressure plate has dual curved surfaces, one on either side of said drive shaft for sequentially occluding at least a pair of transfer tubes out of phase with each other against opposing staggered curved surfaces.

3. The peristaltic pump of claim 2, wherein said pair of transfer tubes are joined to produce a substantially constant pumped fluid output.

* * * * *